US012583563B2

(12) United States Patent
Ishii

(10) Patent No.: US 12,583,563 B2
(45) Date of Patent: Mar. 24, 2026

(54) SHIP DOCKING ASSISTING APPARATUS AND SHIP DOCKING ASSISTING METHOD

(71) Applicant: YAMAHA HATSUDOKI KABUSHIKI KAISHA, Iwata (JP)

(72) Inventor: Takahiro Ishii, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 792 days.

(21) Appl. No.: 16/953,408

(22) Filed: Nov. 20, 2020

(65) Prior Publication Data

US 2021/0070407 A1 Mar. 11, 2021

Related U.S. Application Data

(63) Continuation-in-part of application No. PCT/JP2019/020800, filed on May 27, 2019.

(30) Foreign Application Priority Data

May 29, 2018 (JP) ..... 2018-102337

(51) Int. Cl.
*B63B 79/40* (2020.01)
*B63B 49/00* (2006.01)
(Continued)

(52) U.S. Cl.
CPC ..... *B63B 79/40* (2020.01); *B63B 49/00* (2013.01); *B63B 79/10* (2020.01); *B63H 21/21* (2013.01); *B63H 2021/216* (2013.01)

(58) Field of Classification Search
CPC ..... B63B 49/00; B63B 79/10; B63B 79/40; B63H 2021/216; B63H 21/21; G01B 11/00; G05D 1/0206
See application file for complete search history.

(56) References Cited

U.S. PATENT DOCUMENTS 3,690,767 A * 9/1972 Missio ..... G01S 17/875 356/28
8,978,259 B1 * 3/2015 Stephenson, Jr. ..... G01S 17/88 33/286
(Continued)

FOREIGN PATENT DOCUMENTS

JP 2004-175187 A 6/2004
JP 2006-137309 A 6/2006
(Continued)

OTHER PUBLICATIONS

Official Communication issued in International Patent Application No. PCT/JP2019/020800, mailed on Jul. 30, 2019 and Dec. 1, 2020.
(Continued)

*Primary Examiner* — Fadey S. Jabr
*Assistant Examiner* — Michael J Herrera
(74) *Attorney, Agent, or Firm* — Keating & Bennett, LLP

(57) ABSTRACT

A ship docking assisting apparatus and a ship docking assisting method assist a ship to be accurately docked with reduced hardware. The ship docking assisting apparatus includes a storage and a ship docking assist processor. The ship docking assisting apparatus and the ship docking assisting method assist the docking of the ship by outputting ship information related to the ship to an assist target device. The ship docking assist processor acquires image information including a docking target and the water surface taken by an imager. The ship docking assist processor calculates at least one relative positional relationship between a ship body and the docking target from a plurality of sets of image information. The ship docking assist processor stores the relative positional relationships in the storage as ship information, and outputs the at least one set of ship information stored in the storage to the assist target device.

8 Claims, 11 Drawing Sheets

(51) Int. Cl.
*B63B 79/10* (2020.01)
*B63H 21/21* (2006.01)

(56) References Cited

U.S. PATENT DOCUMENTS

| | | | | |
|---|---|---|---|---|
| 9,904,293 | B1 * | 2/2018 | Heap | G05D 1/12 |
| 2007/0073454 | A1 * | 3/2007 | Kaji | G05D 1/0206 701/21 |
| 2008/0289558 | A1 * | 11/2008 | Montgomery | B63B 21/00 356/601 |
| 2011/0084870 | A1 * | 4/2011 | Kondo | B63B 49/00 342/41 |
| 2015/0089427 | A1 * | 3/2015 | Akuzawa | G05D 1/0206 715/771 |
| 2016/0187883 | A1 * | 6/2016 | Tyers | B63H 21/21 701/21 |
| 2016/0214534 | A1 * | 7/2016 | Richards | H04N 23/11 |
| 2017/0253314 | A1 * | 9/2017 | Ward | B63H 25/42 |
| 2017/0323154 | A1 * | 11/2017 | Kollmann | G06V 20/59 |
| 2018/0004209 | A1 | 1/2018 | Akuzawa et al. | |

FOREIGN PATENT DOCUMENTS

| | | | |
|---|---|---|---|
| JP | 4214219 | B2 | 1/2009 |
| JP | 2018-001945 | A | 1/2018 |

OTHER PUBLICATIONS

Official Communication issued in International Patent Application No. PCT/JP2019/020800, mailed on Jul. 30, 2019.

* cited by examiner

SHIP DOCKING ASSISTING APPARATUS AND SHIP DOCKING ASSISTING METHOD

CROSS REFERENCE TO RELATED APPLICATIONS

This application claims the benefit of priority to Japanese Patent Application No. 2018-102337 filed on May 29, 2018 and is a Continuation-In-Part Application of PCT Application No. PCT/JP2019/020800 filed on May 27, 2019. The entire contents of each application are hereby incorporated herein by reference.

BACKGROUND OF THE INVENTION

1. Field of the Invention

The present invention relates to a ship docking assisting apparatus and a ship docking assisting method which are used to dock a ship.

2. Description of the Related Art

A ship docking assisting apparatus used for docking a ship has been proposed. As a docking assisting apparatus used for docking a ship, a ship docking assisting apparatus disclosed in Japanese Patent No. 4214219 has been known. The ship docking assisting apparatus of Patent Literature 1 includes a plurality of cameras provided on a ship body. After a ship is positioned to be parallel to a wharf at which the ship is to be docked, the docking assisting apparatus take images of a docking target around the wharf by the cameras. Based on location information regarding the docking target calculated by processing the taken images of the docking target, the ship docking assisting apparatus of Japanese Patent No. 4214219 displays the relative positional relationship between the ship body and the docking target around the wharf and the movement of the ship body such as the docking speed of the ship body. In this way, the ship docking assisting apparatus of Japanese Patent No. 4214219 makes it easy to dock the ship.

SUMMARY OF THE INVENTION

Preferred embodiments of the present invention provide ship docking assisting apparatuses and ship docking assisting methods that each assist a ship to be accurately docked with reduced hardware resources. According to a preferred embodiment of the present invention, a ship docking assisting apparatus assists a ship to be accurately docked with reduced hardware resources. According to another preferred embodiment of the present invention, a ship docking assisting method of assisting a ship to be accurately docked with reduced hardware resources uses the ship docking assisting apparatus.

After approaching a shore to some extent by an approaching operation, a ship performs a docking operation which is different from the approaching operation. The docking operation is an operation to cause a ship which is positioned to be parallel to a wharf to make contact with or to move very close to the wharf. The approaching operation is, for example, an operation until the ship is positioned to be parallel to the wharf. The inventors of preferred embodiments of the present invention discovered that, when docking of a ship is performed, the docking was facilitated if, not only the docking operation which was performed when the distance between the ship body and the wharf was short, but also the approaching operation which was performed when the distance between the ship body and the wharf was long were assisted.

In order to assist the approaching operation, the inventors of preferred embodiments of the present invention tried to detect the relative locations of the ship body and the wharf which was the docking target with a camera provided not at a side portion but at a front portion of the ship body. However, in the approaching operation, it was difficult to accurately detect the relative positions of the ship body and the docking target based on an image taken by the camera on the ship body because the distance between the ship body and the docking target was long.

The inventors of preferred embodiments of the present invention have discovered that it is necessary to accurately detect a docking target in order to accurately detect relative positions of the ship body and the docking target. The inventors of preferred embodiments of the present invention have discovered that, when an image of a water surface is taken in addition to an image of the docking target, information of the docking target is accurately sampled from a plurality of sets of image information having been taken, even when the distance between the ship body and the docking target is long. This is because, while the ship is moving, the shape of the water surface tends to change whereas the shape of the docking target does not change and it is easy to detect the docking target from the plurality of sets of image information having been taken. It is therefore possible to accurately detect the docking target even when the distance between the ship body and the docking target is long. The inventors of preferred embodiments of the present invention have discovered that at least one relative positional relationship between the ship body and the docking target in distance and direction is able to be calculated based on the plurality of sets of the image information including the docking target and the water surface, which are acquired by an imager while the ship body is moved forward in a ship body front-rear direction. The inventors of preferred embodiments of the present invention have discovered that the calculated at least one relative positional relationship is able to be used to assist docking which includes the approaching operation and the docking operation. To be more specific, at least one relative positional relationship is output as ship information and the ship information is used to assist the docking. Furthermore, in the approaching operation, the plurality of sets of image information which are different in distance are able to be obtained because the distance between the ship body and the docking target is long. In other words, by using image information taken when the distance is long, it is possible to detect information of the surroundings of the docking target, in addition to the information of the docking target. Meanwhile, in the docking operation, the plurality of sets of image information which are substantially identical in distance are able to obtained because the distance between the ship body and the docking target is short and hence the speed of the ship body is low. In other words, by using image information taken when the distance is short, it is possible to further accurately detect the information of the docking target. In summary, in accordance with the approaching operation and the docking operation, it is possible to assist the docking to be accurately performed by using the information of the docking target and the information of the surroundings of the docking target, which are detected from the plurality of sets of image information.

Meanwhile, when at least one relative positional relationship is calculated and stored as ship information while the ship body is moving, it is unnecessary to store map information in a storage in advance to assist the docking. This map information includes the location of the docking target within a range of movement of the ship body in the approaching operation and the docking operation. It is therefore possible to reduce the region of the storage and to reduce hardware resources. Furthermore, the at least one relative positional relationship which is calculated while the ship body is moving and is stored as the ship information is easily used to assist the docking of the ship. Because the ship information is easily used, the ship information is easily processed by a device to which the ship information is output. In other words, it is possible to reduce hardware resources by improving the efficiency in the processing of the ship information by the device to which the ship information is output.

A ship docking assisting apparatus according to a preferred embodiment of the present invention assists docking of a ship by outputting ship information related to the ship to an assist target device, and includes a storage to store information; and a ship docking assist processor configured or programmed to assist docking of the ship by acquiring image information taken by an imager mounted on the ship and includes a docking target and a water surface, the docking target being a shore or an object in the vicinity of the shore and is used as a mark when the ship is docked; calculating at least one relative positional relationship that indicates the relationship in distance and direction between a ship body of the ship and the docking target from a plurality of sets of the image information including the docking target and the water surface, that are acquired while the ship body is moved forward in a ship body front-rear direction by a propulsion unit provided in the ship body of the ship to generate a propulsion force to move the ship body; storing the at least one relative positional relationship in the storage as the ship information; and outputting the ship information stored in the storage to the assist target device.

According to the above features, the ship docking assisting apparatus assists the docking of a ship by outputting ship information related to the ship to the assist target device. The ship docking assisting apparatus includes the storage and the ship docking assist processor. The storage stores information. The imager takes an image including the docking target and the water surface. The imager is mounted on the ship. The docking target is a shore at which the ship is docked or an object in the vicinity of the shore, and is used as a mark when the ship is docked at the shore. The ship docking assist processor acquires image information including the docking target and the water surface taken by the imager. As a result, the ship docking assisting apparatus is able to acquire the image information of the docking target taken by the imager in the approaching operation. The ship docking assist processor acquires a plurality of sets of image information of both the docking target and the water surface. The sets of the image information include at least two sets of image information of both the docking target and the water surface. Alternatively, the ship docking assist processor may acquire image information of only one of the docking target and the water surface. Alternatively, the ship docking assist processor may acquire image information of none of the docking target and the water surface. Because, while the ship is moving, the shape of the water surface tends to change whereas the shape of the docking target does not change, it is easy to detect the docking target from the plurality of sets of image information. For this reason, even if the distance between the ship body and the docking target is long, it is possible to accurately sample the information of the docking target from the sets of image information having been taken. The ship docking assist processor then calculates at least one relative positional relationship between the ship body and the docking target in distance and direction from the plurality of sets of the image information including the docking target and the water surface, which are acquired by the imager while the ship body is moved forward in the ship body front-rear direction. The ship body is moved forward in the ship body front-rear direction by the propulsion unit which generates propulsion force to move the ship body. The propulsion unit is provided in the ship body. The ship docking assist processor stores the at least one relative positional relationship in the storage as ship information. The ship docking assist processor then assists the docking by outputting the ship information stored in the storage to the assist target device. Furthermore, in the approaching operation, the plurality of sets of image information which are different in distance are obtained because the distance between the ship body and the docking target is long. In other words, by using image information taken when the distance is long, it is possible to detect information of the surroundings of the docking target, in addition to the information of the docking target. Meanwhile, in the docking operation, the plurality of sets of image information which are substantially identical in distance are obtained because the distance between the ship body and the docking target is short. In other words, by using image information taken when the distance is short, it is possible to further accurately detect the information of the docking target. In summary, in accordance with the approaching operation and the docking operation, the ship docking assisting apparatus is able to assist the docking to be accurately performed by using the information of the docking target and the information of the surroundings of the docking target, which are detected from the plurality of sets of image information. Furthermore, because the at least one relative positional relationship calculated while the ship body is moving is output as the ship information, it is unnecessary to store map information in the storage of the ship docking assisting apparatus or the assist target device in advance. This map information includes the location of the docking target within a range of movement of the ship body in the approaching operation and the docking operation. It is therefore possible to reduce the region of the storage of the ship docking assisting apparatus or the assist target device, and to reduce hardware resources of the ship docking assisting apparatus or the assist target device. The at least one relative positional relationship which is output as the ship information is easily used to assist the docking of the ship by the assist target device. Because the ship information is easily used, the ship information is easily processed in the assist target device. It is therefore possible to reduce hardware resources by improving the efficiency of the processing of the ship information in the assist target device. As such, the ship docking assisting apparatus is able to assist the ship to be accurately docked while reducing hardware resources.

According to a preferred embodiment of the present invention, a ship docking assisting apparatus includes the following features, in addition to the feature above.

The imager is mounted on the ship to be able to take an image of the docking target and the water surface which are located forward of the ship body while the ship body is moved forward in the ship body front-rear direction by the propulsion unit.

According to the above features, the imager is able to take an image of the docking target and the water surface in front of the ship body in the ship body front-rear direction while the ship body moves forward in the ship body front-rear direction by the propulsion unit. For example, the imager is provided at a front portion of the ship body. As a result, when the ship is moving forward in the approaching operation, it is easy to take an image of the docking target and the water surface. In other words, the ship docking assist processor is able to easily obtain image information in which an image of the docking target taken by the imager is included. As such, the ship docking assisting apparatus according to the present preferred embodiment is able to assist the ship to be further accurately docked while reducing hardware resources.

According to a preferred embodiment of the present invention, a ship docking assisting apparatus preferably includes the following features, in addition to the above features.

The ship docking assist processor displays an image including the docking target and the water surface on a display mounted on the ship based on image information taken by the imager, and the ship docking assist processor obtains information of the docking target input by an operator by using an input which allows input of information and is mounted on the ship when the image including the docking target and the water surface is displayed on the display.

According to the above features, the ship docking assist processor displays, on the display, an image including the docking target and the water surface based on image information taken by the imager. The display is an apparatus which is mounted on the ship and displays information. Furthermore, the ship docking assist processor acquires information of the docking target set by the operator using the input while an image including the docking target and the water surface is displayed on the display. The input is mounted on the ship and is able to input information. This allows the operator of the ship to set the docking target at will. The ship docking assisting apparatus according to the present preferred embodiment is able to assist the ship to be further accurately docked at a shore desired by the operator while reducing hardware resources.

According to a preferred embodiment of the present invention, a ship docking assisting apparatus preferably includes the following features, in addition to any one of the above features.

The ship docking assist processor calculates a relative speed of the ship body from a plurality of the at least one relative positional relationship, and stores the relative speed of the ship body relative to the docking target in the storage as the ship information.

According to the above features, the ship docking assist processor calculates the speed of the ship body relative to the docking target based on the plurality of relative positional relationships. The ship docking assist processor then stores the relative speed of the ship body in the storage as ship information. The ship docking assist processor is therefore able to further output the relative speed of the ship body as ship information. In this way, the ship docking assisting apparatus is able to use the relative positional relationship between the ship body and the docking target and the relative speed of the ship body to assist the docking. As such, the ship docking assisting apparatus is able to assist the ship to be further accurately docked while reducing hardware resources.

According to a preferred embodiment of the present invention, a ship docking assisting apparatus preferably includes the following features, in addition to any one of the above features.

The ship docking assist processor calculates, from the at least one relative positional relationship, (i) a target angle which is an angle between a bow direction corresponding to a forward direction of the ship body and a target direction corresponding to a direction of the docking target relative to the ship body, (ii) an approach angle which is an angle between the bow direction and a docking direction corresponding to a direction of a border line between a shore at which the ship body is docked and the water surface, and (iii) a target distance which is the shortest distance between the ship body and the docking target, and the ship docking assist processor stores the target angle, the approach angle, and the target distance in the storage as the ship information.

According to the above features, the ship docking assist processor calculates a target angle, an approach angle, and a target distance based on at least one relative positional relationship. The target angle is an angle between a bow direction and a target direction. The bow direction is a forward direction of the ship body. The target direction is a direction in which the docking target is located relative to the ship body. The approach angle is an angle formed between a docking direction and the bow direction. The docking direction is a direction of the border line between the shore at which the ship body is docked and the water surface. When the ship is positioned to be parallel to the wharf and then the ship is docked by making contact with or coming very close to the wharf, the docking direction is parallel to the ship body front-rear direction of the ship body when the ship is docked at the shore. The target distance is the shortest distance between the ship body and the docking target. The ship docking assist processor then stores the target angle, the approach angle, and the target distance having been calculated in the storage as ship information. In other words, the target angle, the approach angle, and the target distance are output to the assist target device and used to assist the docking. The target angle, the approach angle, and the target distance which are output as ship information are easily used to assist the docking of the ship by the assist target device. Because the ship information is easily used, the ship information is easily processed in the assist target device. It is therefore possible to further reduce hardware resources by further improving the efficiency of the processing of the ship information in the assist target device. As such, the ship docking assisting apparatus is able to assist the ship to be further accurately docked while further reducing hardware resources.

According to a preferred embodiment of the present invention, a ship docking assisting apparatus preferably includes the following features, in addition to any one of the above features.

The assist target device is a propulsion unit controller which is able to control the propulsion unit, the ship docking assist processor outputs the ship information from the storage to the propulsion unit controller, and the propulsion unit controller generates a command signal to control the propulsion unit by using the ship information and controls the propulsion unit with the command signal so that the ship body is automatically moved.

According to the above features, the assist target device is a propulsion unit controller that is able to control the propulsion unit. The ship docking assist processor is configured or programmed to output ship information from the storage to the propulsion unit controller. The propulsion unit controller generates a command signal to control the propulsion unit by using output ship information. By using the generated command signal, the propulsion unit controller controls the propulsion unit so that the ship body moves automatically. The propulsion unit is provided in the ship body to generate a propulsion force to move the ship body. The ship docking assisting apparatus is therefore able to assist the approaching operation and the docking operation to be automatically performed until the ship is docked. In the propulsion unit controller which is the assist target device, the ship information is easily used to assist the docking of the ship. Because the ship information is easily used, the ship information is easily processed in the propulsion unit controller which is an assist target device. It is therefore possible to reduce hardware resources by further improving the efficiency of the processing of the ship information in the propulsion unit controller which is an assist target device. As a result, the ship docking assisting apparatus is able to assist the ship to be further accurately docked while further reducing hardware resources.

According to a preferred embodiment of the present invention, a ship docking assisting apparatus preferably includes the following features, in addition to any one of the features.

The assist target device is a propulsion unit controller which is able to control the propulsion unit, the ship docking assist processor outputs the ship information from the storage to the propulsion unit controller, and in accordance with an operation by an operator, the propulsion unit controller generates a command signal to control the propulsion unit by using the ship information output from the storage, and controls the propulsion unit with the command signal.

According to the above features, the assist target device is a propulsion unit controller which is able to control the propulsion unit. The ship docking assist processor is configured or programmed to output ship information from the storage to the propulsion unit controller. In accordance with an operation by an operator, the propulsion unit controller generates a command signal to control the propulsion unit by using the ship information output from the storage. The propulsion unit controller then controls the propulsion unit by using the command signal. With this, the ship docking assisting apparatus is able to assist the operations by the operator in the approaching operation and docking operation until the ship is docked. In the propulsion unit controller which is the assist target device, the ship information is easily used to assist the docking of the ship. Because the ship information is easily used, the ship information is easily processed in the propulsion unit controller which is an assist target device. It is therefore possible to reduce hardware resources by further improving the efficiency of the processing of the ship information in the propulsion unit controller which is an assist target device. As a result, the ship docking assisting apparatus is able to assist the ship to be further accurately docked while further reducing hardware resources.

According to a preferred embodiment of the present invention, a ship docking assisting apparatus preferably includes the following features, in addition to any one of the features.

The assist target device is a display that displays information, the ship docking assist processor outputs the ship information from the storage to the display, and the display displays the ship information or information generated based on the ship information.

According to the above features, the assist target device is a display. The display displays information. The ship docking assist processor outputs ship information from the storage to the display. The display displays ship information or information generated based on the ship information. The display displays ship information. In addition, the display displays information generated based on the ship information (e.g., an operating method in the approaching operation and the docking operation). With this, the ship docking assisting apparatus is able to assist the operator of the ship who sees the display to perform operations in consideration of the ship information in the approaching operation and docking operation until the ship is docked. In the display which is the assist target device, the ship information is easily used to assist the docking of the ship. Because the ship information is easily used, the ship information is easily processed in the display. It is therefore possible to reduce hardware resources by further improving the efficiency of the processing of the ship information in the display. As a result, the ship docking assisting apparatus is able to assist the ship to be further accurately docked while further reducing hardware resources.

A ship docking assisting method according to a preferred embodiment of the present invention assists, by using a ship docking assist processor, docking of a ship by outputting ship information related to the ship to an assist target device, and includes, under control of the ship docking assist processor, acquiring image information which is taken by an imager mounted on the ship and includes a docking target and a water surface, the docking target being a shore at which the ship is docked or an object in the vicinity of the shore and is used as a mark when the ship is docked; calculating at least one relative positional relationship which indicates the relationship between a ship body of the ship and the docking target from a plurality of sets of the image information including the docking target and the water surface, which are acquired while the ship body is moved forward in a ship body front-rear direction by a propulsion unit provided in the ship body of the ship to generate a propulsion force to move the ship body; storing the at least one relative positional relationship in the storage as the ship information; and outputting the ship information stored in the storage to the assist target device.

According to the above features, the ship docking assisting method assists, by using the ship docking assist processor, the docking of a ship by outputting ship information related to the ship to the assist target device. The ship docking assist processor acquires image information including the docking target and the water surface taken by the imager. The imager takes an image including the docking target and the water surface. The imager is mounted on the ship. The docking target is a shore at which the ship is docked or an object in the vicinity of the shore, and is used as a mark when the ship is docked at the shore. As a result, the ship docking assist processor is able to acquire the image information of the docking target taken by the imager during the approaching operation. The ship docking assist processor acquires a plurality of sets of image information of both the docking target and the water surface. The sets of the image information include at least two sets of image information of both the docking target and the water surface. Alternatively, the ship docking assist processor may acquire image information of only one of the docking target and the water surface. Alternatively, the ship docking assist processor may acquire image information of none of the docking target and the water surface. Because, while the ship is moving, the shape of the water surface tends to change whereas the shape of the docking target does not change, it is easy to detect the docking target from the plurality of sets of image information. For this reason, even if the distance between the ship body and the docking target is long, it is possible to accurately sample the information of the docking target from the sets of image information having been taken. The ship docking assist processor then calculates at least one relative positional relationship between the ship body and the docking target in distance and direction from the plurality of sets of the image information including the docking target and the water surface, which are acquired by the imager while the ship is moved forward in the ship body front-rear direction. The ship body is moved forward in the ship body front-rear direction by the propulsion unit which generates propulsion force to move the ship body. The propulsion unit is provided in the ship body. The ship docking assist processor stores the at least one relative positional relationship in the storage as ship information. The ship docking assist processor then assists the docking by outputting the ship information stored in the storage to the assist target device. Furthermore, in the approaching operation, the plurality of sets of image information which are different in distance are able to be obtained because the distance between the ship body and the docking target is long. In other words, by using image information taken when the distance is long, it is possible to detect information of the surroundings of the docking target, in addition to the information of the docking target. Meanwhile, in the docking operation, the plurality of sets of image information which are substantially identical in distance are able to be obtained because the distance between the ship body and the docking target is short. In other words, by using image information taken when the distance is short, it is possible to further accurately detect the information of the docking target. In summary, in accordance with the approaching operation and the docking operation, the ship docking assist method is able to assist the docking to be accurately performed by using the information of the docking target and the information of the surroundings of the docking target, which are detected from the plurality of sets of image information. Furthermore, because the at least one relative positional relationship calculated while the ship body is moving is output as the ship information, it is unnecessary to store map information in the storage of the ship docking assisting apparatus or the assist target device in advance. This map information includes the location of the docking target within a range of movement of the ship body in the approaching operation and the docking operation. It is therefore possible to reduce the region of the storage of the ship docking assisting apparatus or the assist target device, and to reduce hardware resources of the ship docking assisting apparatus or the assist target device. The at least one relative positional relationship which is output as the ship information is easily used to assist the docking of the ship by the assist target device. Because the ship information is easily used, the ship information is easily processed in the assist target device. It is therefore possible to reduce hardware resources by improving the efficiency of the processing of the ship information in the assist target device. As such, the ship docking assist method is able to assist the ship to be accurately docked while reducing hardware resources.

According to a preferred embodiment of the present invention, a ship docking assist method preferably includes the following features, in addition to the above features.

The imager is mounted on the ship to be able to take an image of the docking target and the water surface which are located forward of the ship body while the ship body is moved forward in the ship body front-rear direction by the propulsion unit.

According to the above features, the imager is able to take an image of the docking target and the water surface in front of the ship body in the ship body front-rear direction while the ship body moves forward in the ship body front-rear direction by the propulsion unit. For example, the imager is provided at a front portion of the ship body. As a result, when the ship is moving forward in the approaching operation, it is easy to take an image of the docking target and the water surface. In other words, the ship docking assist processor easily obtains image information in which an image of the docking target taken by the imager is included. The ship docking assist method is therefore able to assist the ship to be further accurately docked.

According to a preferred embodiment of the present invention, a ship docking assist method preferably includes the following features, in addition to the above features.

In addition to the above, the ship docking assist processor displays an image including the docking target and the water surface on a display mounted on the ship based on image information taken by the imager; and obtains information of the docking target input by an operator by using an input which allows input of information and is mounted on the ship when the image including the docking target and the water surface is displayed on the display.

According to the above features, the ship docking assist processor displays, on the display, an image including the docking target and the water surface based on image information taken by the imager. The display is mounted on the ship and displays information. Furthermore, the ship docking assist processor acquires information of the docking target set by the operator using the input, while an image including the docking target and the water surface is displayed on the display. The input is mounted on the ship and is able to input information. This allows the operator of the ship to set the docking target at will. The ship docking assist method is able to assist the ship to be further accurately docked at a shore desired by the operator.

According to a preferred embodiment of the present invention, a ship docking assist method preferably includes the following features, in addition to any one of the above features.

The ship docking assist method calculates a relative speed of the ship body from a plurality of the at least one relative positional relationship, and stores the relative speed of the ship body relative to the docking target in the storage as the ship information.

According to the above features, the ship docking assist processor calculates the speed of the ship body relative to the docking target based on the plurality of relative positional relationships. The ship docking assist processor then stores the relative speed of the ship body in the storage as ship information. The ship docking assist processor is therefore able to further output the relative speed of the ship body as ship information. In this way, the ship docking assist processor is able to use the relative positional relationship between the ship body and the docking target and the relative speed of the ship body to assist the docking. In this way, the ship docking assist method is therefore able to assist the ship to be further accurately docked.

According to a preferred embodiment of the present invention, a ship docking assist method preferably includes the following features, in addition to any one of the above features.

In addition, the ship docking assist processor calculates, from the at least one relative positional relationship, (i) a target angle defined as an angle between a bow direction corresponding to a forward direction of the ship body and a target direction corresponding to a direction of the docking target relative to the ship body, (ii) an approach angle defined as an angle between the bow direction and a docking direction corresponding to a direction of a border line between a shore at which the ship body is docked and the water surface, and (iii) a target distance which is the shortest distance between the ship body and the docking target, and the ship docking assist processor stores the target angle, the approach angle, and the target distance in the storage as the ship information.

According to the above features, the ship docking assist processor calculates a target angle, an approach angle, and a target distance based on at least one relative positional relationship. The target angle is an angle between a bow direction and a target direction. The bow direction is a forward direction of the ship body. The target direction is a direction in which the docking target is located relative to the ship body. The approach angle is an angle formed between a docking direction and the bow direction. The docking direction is a direction of the border line between the shore at which the ship body is docked and the water surface. When the ship is positioned to be parallel to the wharf and then the ship is docked by making contact with or coming very close to the wharf, the docking direction is parallel to the ship body front-rear direction of the ship body when the ship is docked at the shore. The target distance is the shortest distance between the ship body and the docking target. The ship docking assist processor then stores the target angle, the approach angle, and the target distance having been calculated in the storage as ship information. In other words, the target angle, the approach angle, and the target distance are output to the assist target device and used to assist the docking. The target angle, the approach angle, and the target distance which are output as ship information are easily used to assist the docking of the ship by the assist target device. Because the ship information is easily used, the ship information is easily processed in the assist target device. It is therefore possible to further reduce hardware resources by further improving the efficiency of the processing of the ship information in the assist target device. As such, the ship docking assist method is able to assist the ship to be further accurately docked while further reducing hardware resources.

According to a preferred embodiment of the present invention, a ship docking assist method preferably includes the following features, in addition to any one of the above features.

The assist target device is a propulsion unit controller which is able to control the propulsion unit, the ship docking assist processor outputs the ship information from the storage to the propulsion unit controller, and the propulsion unit controller generates a command signal to control the propulsion unit by using the ship information, and controls the propulsion unit with the command signal so that the ship body is automatically moved.

According to the above features, the assist target device is a propulsion unit controller which is able to control the propulsion unit. The ship docking assist processor is configured or programmed to output ship information from the storage to the propulsion unit controller. The propulsion unit controller generates a command signal to control the propulsion unit by using output ship information. By using the generated command signal, the propulsion unit controller controls the propulsion unit so that the ship body moves automatically. The propulsion unit is provided in the ship body to generate a propulsion force to move the ship body. The ship docking assisting apparatus is therefore able to assist the approaching operation and the docking operation to be automatically performed until the ship is docked. In the propulsion unit controller which is the assist target device, the ship information is easily used to assist the docking of the ship. Because the ship information is easily used, the ship information is easily processed in the propulsion unit controller. It is therefore possible to reduce hardware resources by further improving the efficiency of the processing of the ship information in the propulsion unit controller. As a result, the ship docking assist method is able to assist the ship to be further accurately docked while further reducing hardware resources.

According to a preferred embodiment of the present invention, a ship docking assist method preferably includes the following features, in addition to any one of the above features.

The assist target device is a propulsion unit controller which is able to control the propulsion unit, the ship docking assist processor outputs the ship information from the storage to the propulsion unit controller, and in accordance with an operation by an operator, the propulsion unit controller generates a command signal to control the propulsion unit by using the ship information output from the storage, and controls the propulsion unit with the command signal.

According to the above features, the assist target device is a propulsion unit controller which is able to control the propulsion unit. The ship docking assist processor is configured or programmed to output ship information from the storage to the propulsion unit controller. In accordance with an operation by an operator, the propulsion unit controller generates a command signal to control the propulsion unit by using the ship information output from the storage. The propulsion unit controller then controls the propulsion unit by using the command signal. With this, the ship docking assisting apparatus is able to assist the operations by the operator in the approaching operation and docking operation until the ship is docked. In the propulsion unit controller which is the assist target device, the ship information is easily used to assist the docking of the ship. Because the ship information is easily used, the ship information is easily processed in the propulsion unit controller. It is therefore possible to reduce hardware resources by further improving the efficiency of the processing of the ship information in the propulsion unit controller. As a result, the ship docking assist method is able to assist the ship to be further accurately docked while further reducing hardware resources.

According to a preferred embodiment of the present invention, a ship docking assist method preferably includes the following features, in addition to any one of the above features.

The assist target device is a display which displays information, the ship docking assist processor outputs the ship information from the storage to the display, and the display displays the ship information or information generated based on the ship information.

According to the above features, the assist target device is a display. The display displays information. The ship docking assist processor outputs ship information from the storage to the display. The display displays ship information or information generated based on the ship information. The display displays ship information. In addition, the display displays information generated based on the ship information (e.g., an operating method in the approaching operation and the docking operation). With this, the ship docking assisting apparatus is able to assist the operator of the ship who sees the display to perform operations in consideration of the ship information in the approaching operation and docking operation until the ship is docked. In the display which is the assist target device, the ship information is easily used to assist the docking of the ship. Because the ship information is easily used, the ship information is easily processed in the display. It is therefore possible to reduce hardware resources by further improving the efficiency of the processing of the ship information in the display. As a result, the ship docking assist method is able to assist the ship to be further accurately docked while further reducing hardware resources.

In preferred embodiments of the present invention, a ship is buoyant and has self-navigation capability. The self-navigation capability indicates that the ship is able to navigate actively. An example of a ship which does not have self-navigation capability is a ship which is pulled or pushed by another ship. A ship having self-navigation capability includes a propulsion unit which is provided in a ship body to generate a propulsion force to move the ship body. The ship encompasses a large ship and a small ship. The large ship is a ship of 20 or more tons gross. The large ship is, for example, a tanker. The small ship is a ship of less than 20 tons gross. The small ship is, for example, a jet propulsion boat such as a jet boat and a sport boat. A ship according to a preferred embodiment of the present invention is preferably a small ship.

In preferred embodiments of the present invention, docking indicates that a ship makes contact with or moves very close to a shore at which the ship is to be docked. In a preferred embodiment of the present invention, docking may indicate that a ship is docked so that the ship body front-rear direction is parallel to the shore. In this case, for example, the ship may move only forward in the ship body front-rear direction, or may rotate at a location close to the shore. In a preferred embodiment of the present invention, docking may indicate that a ship moves forward and is docked so that the bow is closer to the shore than the stern is to the shore. In a preferred embodiment of the present invention, docking may indicate that a ship moves rearward and is docked so that the stern is closer to the wharf than the bow is to the wharf. The forward movement in this case indicates that the ship moves forward in the ship body front-rear direction. The rearward movement in this case indicates that the ship moves rearward in the ship body front-rear direction. In a preferred embodiment of the present invention, a docking target is a shore at which the ship is docked or an object in the vicinity of the shore, and is used as a mark when the ship is docked. The shore encompasses all kinds of land in contact with water surfaces on which ships are able to navigate. The shore encompasses a sea shore, a lake shore, a river shore, and a pond shore. The shore may encompass a pier and other ships.

In preferred embodiments of the present invention, the relative positional relationship between a ship body and a docking target indicates the relationship in distance and direction between the ship body and the docking target. The relative positional relationship between the ship body and the docking target is, for example, represented by two-dimensional or three-dimensional coordinates. Alternatively, the relative positional relationship between the ship body and the docking target is, for example, represented by two-dimensional or three-dimensional vectors.

When at least one relative positional relationship include a plurality relative positional relationships, these relative positional relationships are those of the ship body and the docking target at different times. In a preferred embodiment of the present invention, a plurality of sets of image information used to calculate at least one relative positional relationship include sets of image information taken by an imager at different times.

In preferred embodiments of the present invention, ship information indicates information related to a ship. The information indicates information through which any knowledge can be obtained, and is represented by data. The data is representation of the information. The data is suitable to being transmitted, interpreted, or processed, and the information can be reconstructed from the data.

In preferred embodiments of the present invention, an imager indicates a device which is able to store, as image information, a still image or a moving image taken by imaging elements which are able to convert light from an object into image data.

In preferred embodiments of the present invention, a ship docking assist processor encompasses a microcontroller, a CPU (Central Processing Unit), a GPU (Graphics Processing Unit), a microprocessor, an application specific integrated circuit (ASIC), a programmable logic circuit (PLC), a field programmable gate array (FPGA), and other types of circuits, and is a device which is programmed or configured to execute processes described herein.

In preferred embodiments of the present invention, a storage indicates a device which includes a recording medium such as a RAM (Random Access Memory) and a ROM (Read Only Memory) and is configured to store data. In a preferred embodiment of the present invention, the storage encompasses a main storage, an auxiliary storage, a register, and the like.

In preferred embodiments of the present invention, an assist target device is a device which is a target of output of ship information. The assist target device encompasses, for example, a propulsion unit controller and a display.

In preferred embodiments of the present invention, a display indicates a device configured to display information. The display includes a display unit configured to display information and a calculation unit configured to calculate the information to be displayed. The display unit of the display is, for example, a liquid crystal display.

In preferred embodiments of the present invention, an input indicates a device by which information is input. The input encompasses a keyboard, a mouse, and a touch panel.

In a preferred embodiment of the present invention, an end portion of a member indicates a portion defined by an end and its surroundings of the member.

In a preferred embodiment of the present invention, a direction along an A direction is not limited to a direction parallel to the A direction. A direction along the A direction includes a linear line which intersects with the A direction at an angle which falls within the range from −45 degrees to 45 degrees. The same definition applies to other expressions using "along". The other expressions using "along" are, for example, "direction along the A direction", "plurality of B are lined up along the A direction", and "a single B is provided along the A direction". The direction A does not indicate any specific direction. The direction A may be the horizontal direction or the front-rear direction.

In a preferred embodiment of the present invention, an expression "members A and B are lined up in an X direction" indicates the following state. When the members A and B are viewed in a direction perpendicular to the X direction, the members A and B are both provided on a linear line which is parallel to the X direction. In a preferred embodiment of the present invention, an expression "members A and B are provided side by side in an X direction when viewed in a Y direction" indicates the following state. When the members A and B are viewed in the Y direction, the members A and B are both provided on a linear line which is parallel to the X direction. In this regard, when the members A and B are viewed in a Z direction which is different from the Y direction, the member A or B may not be provided on the linear line which is parallel to the X direction. The members A and B may be in contact with each other. The members A and B may not be in contact with each other. A member C may be provided between the members A and B.

In preferred embodiments of the present invention, an expression "a member A is provided forward of a member B" indicates the following state. The member A is provided in front of a plane which passes the front-most end of the member B and is perpendicular to the front-rear direction. In this connection, the members A and B may or may not be lined up in the front-rear direction. The same applies to expressions "a member A is provided rearward of a member B", "a member A is provided above a member B", "a member A is provided below a member B", and "a member A is provided rightward of or leftward of a member B".

In preferred embodiments of the present invention, an expression "a member A is provided in front of a member B" indicates the following state. The members A and B are lined up in the front-rear direction and a portion of the member A, the portion facing the member B, is provided in front of the member B. According to this definition, when a portion of the front surface of the member B, the portion facing the member A, is the front-most end of the member B, the member A is provided forward of the member B. According to the definition, when a portion of the front surface of the member B, the portion facing the member A, is not the front-most end of the member B, the member A may or may not be provided forward of the member B. The same applies to expressions "a member A is provided behind a member B", "a member A is provided directly above a member B", "a member A is provided directly below a member B", and "a member A is provided to the right of or to the left of a member B". The front surface of the member B is a surface which is viewable when the member B is viewed from the front side. Depending on the shape of the member B, the front surface of the member B may include a plurality of surfaces, instead of a single continuous surface.

In preferred embodiments of the present invention, terms "including", "comprising", "having", and derivatives thereof are used to encompass not only listed items and equivalents thereof but also additional items. The terms "mounted", "connected", and "coupled" are used in broad sense. To be more specific, the terms encompass not only directly mounting, connection, and coupling but also indirect mounting, connection, and coupling. Furthermore, the terms "connected" and "coupled" do not merely indicate physical or mechanical connection and coupling. These terms encompass direct or indirect electric connection and coupling.

Unless otherwise defined, all terms (technical and scientific terms) used in this specification indicate meanings typically understood by a person with ordinary skill in the art in the technical field to which the present invention belongs.

Terms defined in typical dictionaries indicate meanings used in related technologies and in the context of the present disclosure. The terms are not interpreted ideally or excessively formally.

In preferred embodiments of the present invention, the term "preferable" is non-exclusive. The term "preferable" means "preferable but not limited to". In this specification, a feature which is "preferable" exerts at least the above-described effects of the features described above. In this specification, the term "may" is non-exclusive. The term "may" indicate "may but not must". In this specification, a feature which is explained by using the term "may" exert at least the above-described effects of the features described above.

In the claims, when the number of a feature is not clearly specified and the feature is expressed in a singular form in English, the number of the feature may be more than one in preferred embodiments of the present invention. In a preferred embodiment of the present invention, the number of the features may be only one.

In a preferred embodiment of the present invention, the features of the above-described different aspects may be variously combined.

Before preferred embodiments of the present invention are described in detail, the present invention is not limited to the configurations and layout of elements described below and/or shown in drawings. The present invention may be implemented as other preferred embodiments, or as a preferred embodiment with various changes. Furthermore, the present invention may be implemented by suitably combining below-described modifications.

The ship docking assisting apparatuses and the ship docking assisting methods of preferred embodiments of the present invention allow a ship to be accurately docked with reduced hardware resources.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
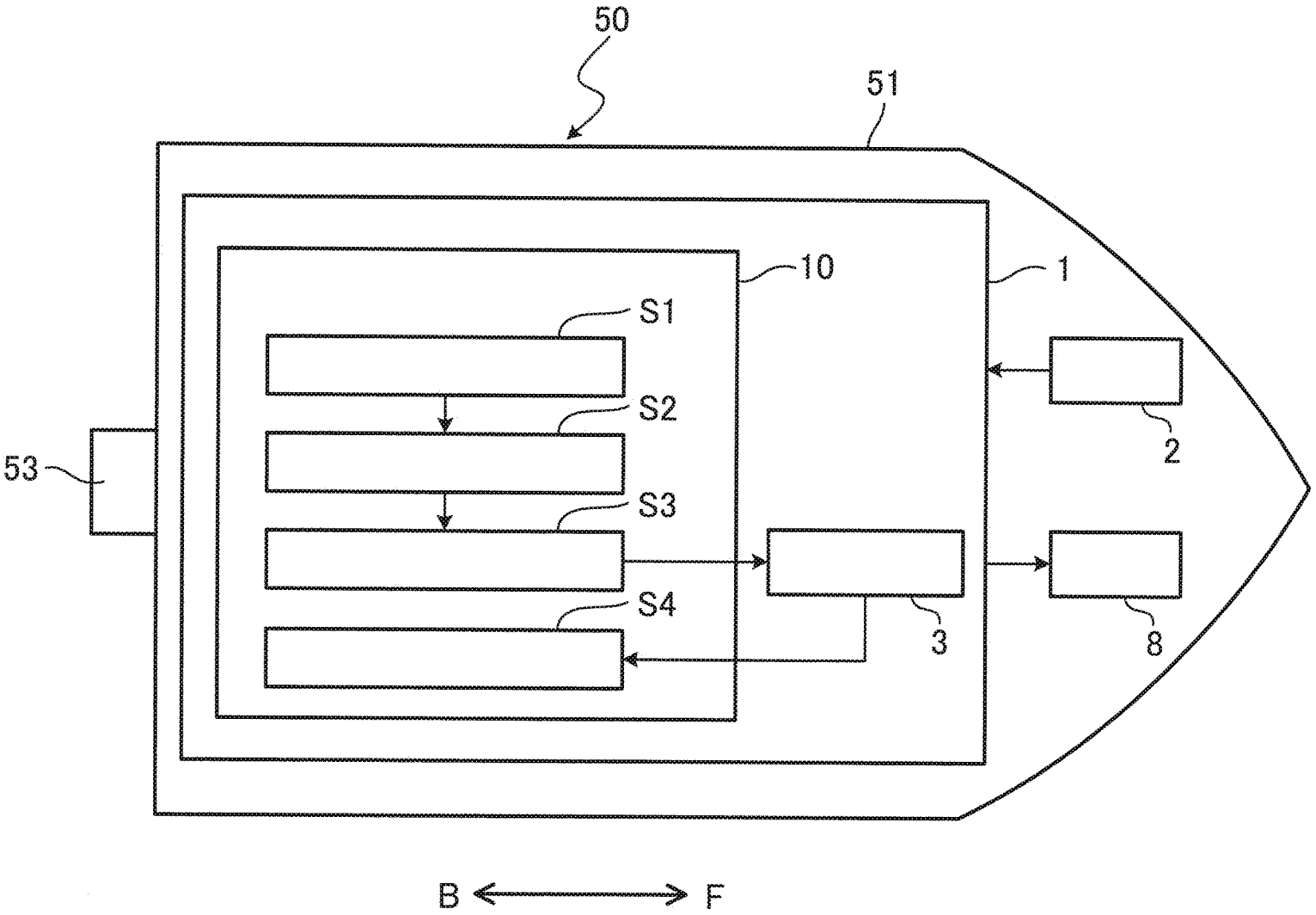
FIG. 1 outlines a ship docking assisting apparatus and a ship docking assisting method according to a preferred embodiment of the present invention.

The following will describe ship docking assisting apparatuses and ship docking assisting methods according to various preferred embodiments of the present invention. FIG. 1 is a schematic view of a ship docking assisting apparatus of the preferred embodiment of the present invention. Arrows F and B in FIG. 1 indicate forward and rearward in a ship body front-rear direction, respectively.

A ship docking assisting apparatus 1 of the present preferred embodiment assists the docking of a ship 50 by outputting ship information related to the ship 50 to an assist target device. As shown in FIG. 1, the ship docking assisting apparatus 1 includes a storage 3 and a ship docking assist processor 10. A ship docking assisting method of the present preferred embodiment assists, by using the ship docking assist processor 10, the docking of the ship 50 by outputting ship information related to the ship 50 to an assist target device.

An imager 2 is mounted on the ship 50. The storage 3 stores information.

The ship docking assist processor 10 is configured or programmed to execute processes described below.

The ship docking assist processor 10 acquires image information including a docking target and a water surface taken by the imager 2 (step S1). The docking target is a shore at which the ship is docked or an object in the vicinity of the shore, and is used as a mark when the ship 50 is docked at the shore.

The ship docking assist processor 10 calculates at least one relative positional relationship between a ship body 51 and the docking target, from a plurality of sets of image information obtained while the ship 50 is moved forward in the ship body front-rear direction by a propulsion unit 53 (step S2). The propulsion unit 53 is provided in the ship body 51 of the ship 50 to generate a propulsion force to move the ship body 51. The sets of the image information include at least two sets of image information of both the docking target and the water surface. Alternatively, the ship docking assist processor 10 may acquire image information of only one of the docking target and the water surface. Alternatively, the ship docking assist processor 10 may acquire image information of none of the docking target and the water surface.

The ship docking assist processor 10 stores the at least one relative positional relationship in the storage 3 as ship information (step S3).

The ship docking assist processor 10 outputs the at least one set of ship information stored in the storage 3 to an assist target device 8 (step S4).

According to the above features, the ship docking assisting apparatus 1 and the ship docking assisting method of the present preferred embodiment exert the following effects.

The ship docking assist processor 10 acquires image information including the docking target and the water surface taken by the imager 2 (step S1). As a result, the ship docking assisting apparatus 1 is able to acquire the image information of the docking target taken by the imager 2 in the approaching operation.

The ship docking assist processor 10 calculates at least one relative positional relationship between the ship body 51 and the docking target from a plurality of sets of image information including the docking target and the water surface, which are taken by the imager 2 while the ship 51 moves forward in the ship body front-rear direction (step S3). The ship docking assist processor 10 acquires a plurality of sets of image information of both (i) the shore at which the ship is docked or the docking target around the shore, and (ii) the water surface. In this regard, because the shape of the water surface tends to change whereas the shape of the docking target does not change while the ship 50 is moving, it is easy to detect the docking target from the plurality of sets of image information. For this reason, even if the distance between the ship body 51 and the docking target is long, it is possible to sample the information of the docking target by removing the information of the water surface from the sets of image information having been taken. The ship docking assist processor 10 stores the relative positional relationship in the storage 3 as ship information (step S4). The ship docking assist processor 10 then assists the docking by outputting the at least one set of ship information stored in the storage 3 to the assist target device 8.

Furthermore, in the approaching operation, a plurality of sets of image information which are different in distance are able to be obtained because the distance between the ship body 51 and the docking target is long. In other words, by using image information taken when the distance is long, it is possible to detect information of the surroundings of the docking target, in addition to the information of the docking target. Meanwhile, in the docking operation, a plurality of sets of image information which are substantially identical in distance are able to be obtained because the distance between the ship body 51 and the docking target is short. In other words, by using image information taken when the distance is short, it is possible to further accurately detect the information of the docking target. In summary, in the ship docking assisting apparatus 1 and the ship docking assisting method of the present preferred embodiment, in accordance with the approaching operation and the docking operation, it is possible to assist the docking to be accurately performed by using the information of the docking target and the information of the surroundings of the docking target, which are detected from the plurality of sets of image information.

Furthermore, because the at least one relative positional relationship calculated while the ship body 51 is moving is output as the ship information, it is unnecessary to store map information in the storage 3 or a storage of the assist target device 8 in advance to assist the docking. This map information includes the location of the docking target within a range of movement of the ship body in the approaching operation and the docking operation. It is therefore possible to reduce the region of the storage 3 or the storage in the assist target device 8, and to reduce hardware resources of the ship docking assisting apparatus 1 or the assist target device 8. The at least one relative positional relationship which is output as the ship information is easily used to assist the docking of the ship by the assist target device 8. Because the ship information is easily used, the ship information is easily processed in the assist target device 8. It is therefore possible to reduce hardware resources by improving the efficiency of the processing of the ship information in the assist target device 8.

As such, the ship docking assisting apparatus 1 and the ship docking assisting method of the present preferred embodiment are able to assist the ship 50 to be accurately docked while reducing hardware resources.

The following will describe a ship docking assisting apparatus 1 and a ship docking assisting method of a specific example according to a preferred embodiment of the present invention, with reference to FIG. 2 to FIG. 9. Basically, the ship docking assisting apparatus 1 includes all of the features of the above-described ship docking assisting apparatus 1. It is noted that portions identical with those of the ship docking assisting apparatus 1 are not explained again. Basically, the ship docking assist method includes all of the features of the above-described ship docking assist method. It is noted that processes identical with those of the ship docking assist method are not explained again.

Figure 2:
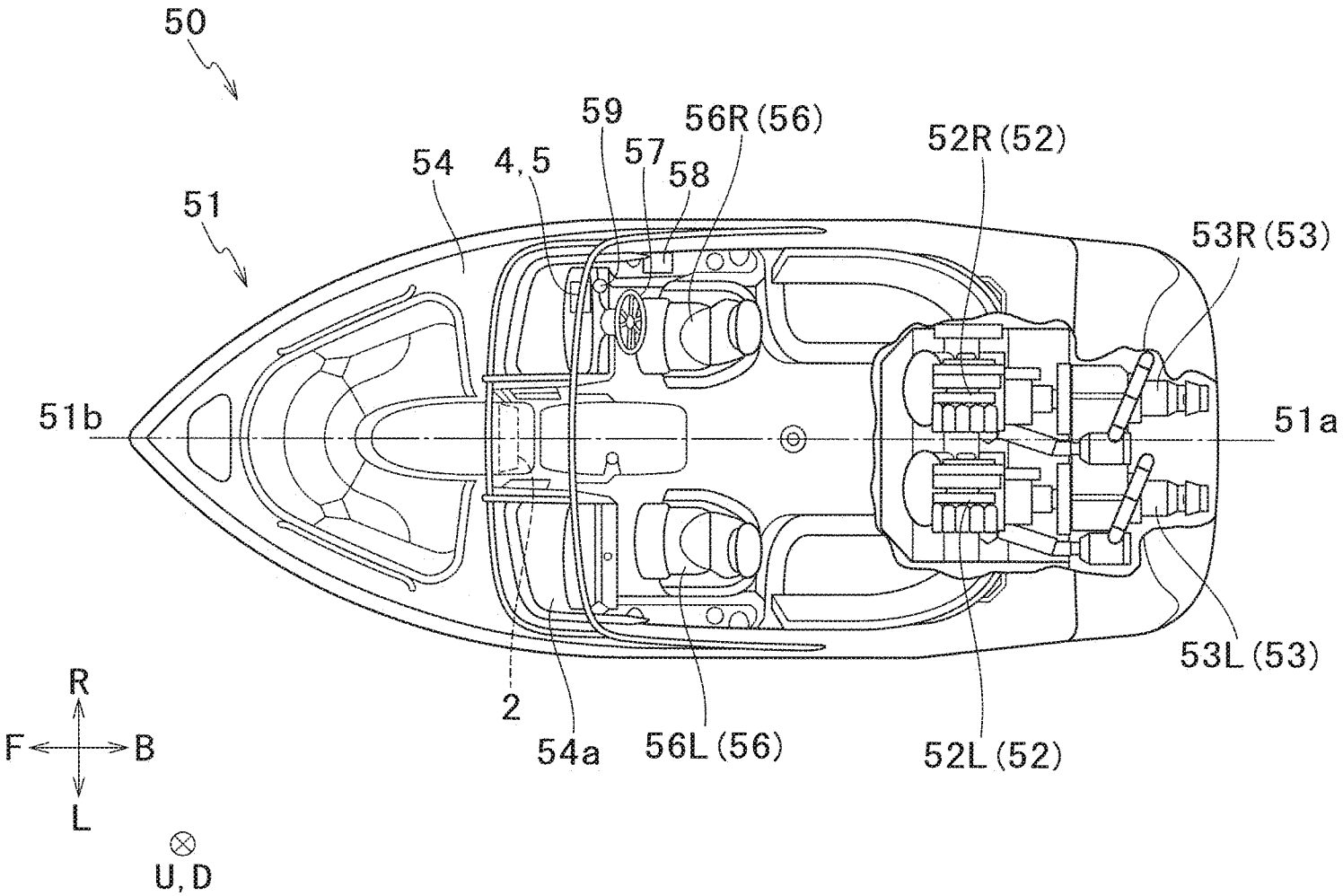
FIG. 2 is a plan view showing an example of a ship on which a ship docking assisting apparatus of a specific example is mounted.
Figure 3:
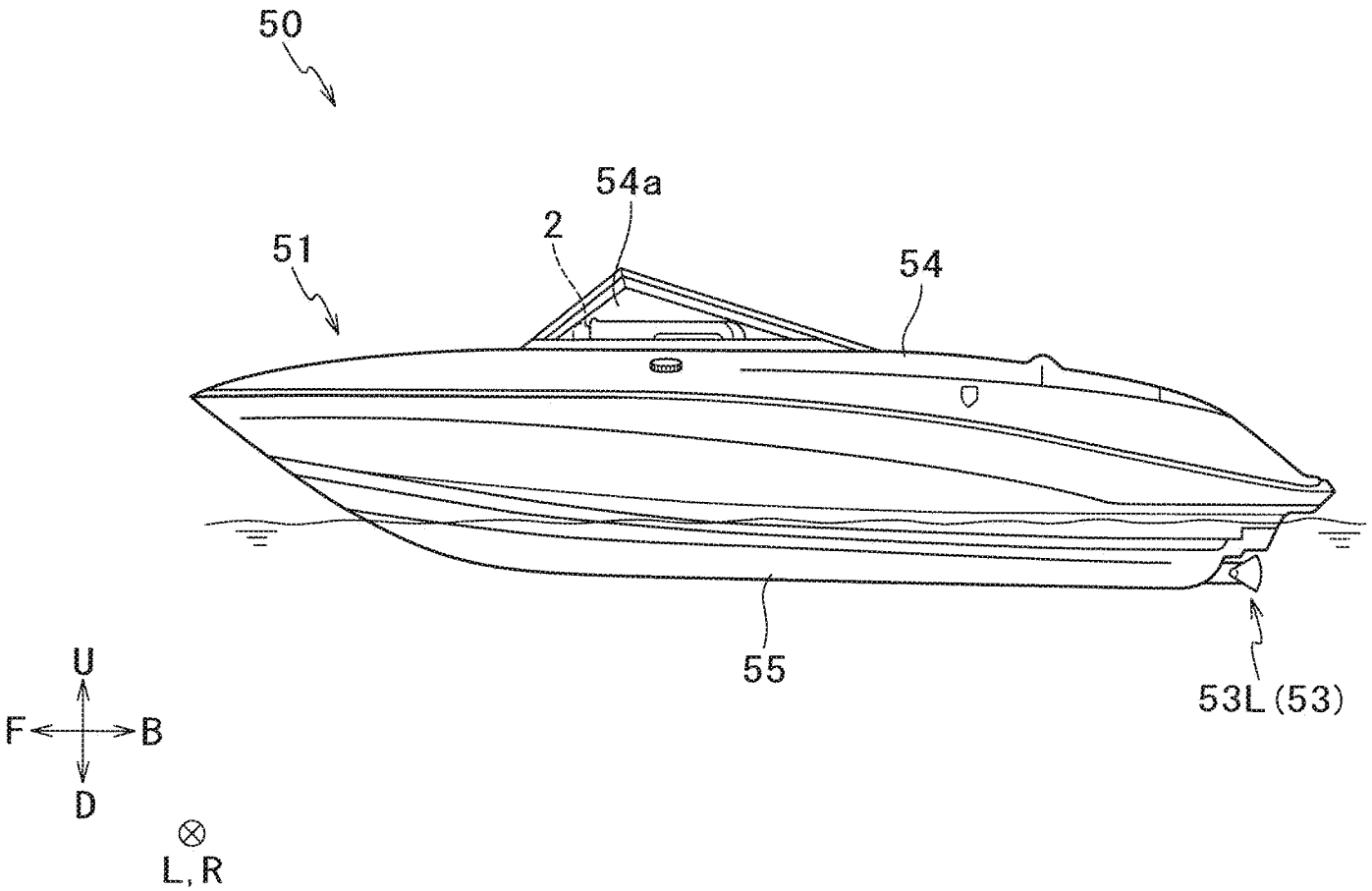
FIG. 3 is a side view of the ship shown in FIG. 2.

The following will describe an example of a ship on which the ship docking assisting apparatus 1 is mounted, with reference to figures. FIG. 2 is a plan view of the ship 50 of the specific example. In FIG. 2, only portions of the internal structure of the ship 50 are shown. FIG. 3 is a side view of the ship 50 shown in FIG. 2. In the specific example, the ship 50 is a small ship. To be more specific, the ship 50 is, for example, a jet propulsion boat such as a jet boat and a sport boat.

The ship body 51 of the ship 50 includes a stern 51*a* and a bow 51*b*. The stern 51*a* is a rear end portion in the ship body front-rear direction. The bow 51*b* is a front end portion in the ship body front-rear direction. The ship body front-rear direction is a direction parallel to a center line 51*c* which passes through the center of the stern 51*a* and the center of the bow 51*b*. A ship body up-down direction is a vertical direction. A ship body left-right direction is a direction perpendicular to both the ship body front-rear direction and the ship body up-down direction. An arrow F in each figure indicates forward in the ship body front-rear direction. An arrow B in each figure indicates rearward in the ship body front-rear direction. An arrow L in each figure indicates leftward in the ship body left-right direction. An arrow R in each figure indicates rightward in the ship body left-right direction. An arrow U in each figure indicates upward in the ship body up-down direction. An arrow D in each figure indicates downward in the ship body up-down direction.

The small ship 50 includes a ship body 51, an engine unit 52, and a propulsion unit 53. The ship body 51 includes a deck 54 and a hull 55. The hull 55 is provided below the deck 54 in the ship body up-down direction. A seat section 56 is provided on the deck 54.

The engine unit 52 includes two engines 52L and 52R. To be more specific, the engine unit 52 includes a left engine 52L and a right engine 52R. The left engine 52L and the right engine 52R are aligned in the ship body left-right direction. The left engine 52L is provided to the left of the right engine 52R in the ship body left-right direction. The right engine 52R is provided to the right of the left engine 52L in the ship body left-right direction. The number of engines in the engine unit is not limited to two. The number of engines may be one, or may be three or more. The engine unit 52 is accommodated in the ship body 51. The engine unit 52 is provided at a rear portion of the ship body 51.

The propulsion unit 53 includes two thrusters 53L and 53R. To be more specific, the propulsion unit 53 includes a left thruster 53L and a right thruster 53R. The left thruster 53L and the right thruster 53R are aligned in the ship body left-right direction. The left thruster 53L is provided to the left of the right thruster 53R in the ship body left-right direction. The right thruster 53R is provided to the right of the left thruster 53L in the ship body left-right direction. The number of thrusters in the propulsion unit is not limited to two. The number of thrusters may be one, or may be three or more. The propulsion unit 53 is provided at the stern 51*a*.

The output shaft of the left engine 52L is connected to the left thruster 53L. The output shaft of the right engine 52R is connected to the right thruster 53R. The left thruster 53L is driven by the left engine 52L to generate a propulsion force to move the ship body 51. The right thruster 53R is driven by the right engine 52R to generate a propulsion force to move the ship body 51.

Figure 4:
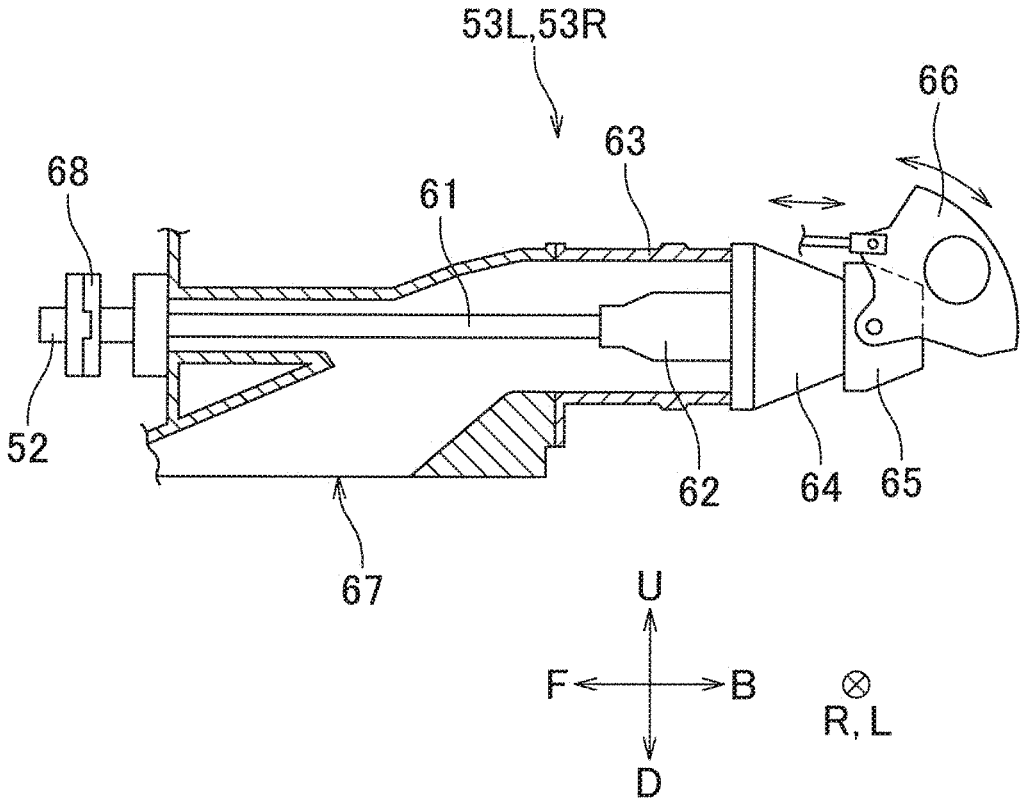
FIG. 4 is a side view and a cross section showing the structure of a propulsion unit of the ship shown in FIG. 2.

The propulsion unit 53 is a jet propulsion unit which draws in water around the ship body 51 and jets out the water. The propulsion unit 53 will be detailed with reference to FIG. 4. FIG. 4 is a side view showing the structure of each of the two thrusters 53L and 53R of the propulsion unit 53. In FIG. 4, each of the thrusters 53L and 53R is partially shown in cross section. The thrusters 53L and 53R are structurally identical to each other. The thrusters 53L and 53R may not be structurally identical to each other.

As shown in FIG. 4, each of the thrusters 53L and 53R includes an impeller shaft 61, an impeller 62, an impeller housing 63, a nozzle 64, a deflector 65, and a reverse bucket 66. The impeller shaft 61 is provided along the ship body front-rear direction. A front portion in the ship body front-rear direction of the impeller shaft 61 is connected to the output shaft of the engine unit 52 via a coupling 68. A rear portion in the ship body front-rear direction of the impeller shaft 61 is provided in the impeller housing 63. The impeller housing 63 is provided rearward of a water intake portion 67 in the ship body front-rear direction. The nozzle 64 is provided behind the impeller housing 63 in the ship body front-rear direction.

The impeller 62 is provided at a rear portion in the ship body front-rear direction of the impeller shaft 61. The impeller 62 is provided in the impeller housing 63. The impeller 62 rotates together with the impeller shaft 61. As a result, water is drawn in through the water intake portion 67. The impeller 62 jets out the drawn in water rearward in the ship body front-rear direction, through the nozzle 64.

The deflector 65 is provided behind the nozzle 64 in the ship body front-rear direction. The deflector 65 is arranged so that the orientation in the ship body left-right direction of the deflector 65 is changeable by an unillustrated actuator. The deflector 65 jets out the water supplied from the nozzle 64 in the left-right direction. In other words, the deflector 65 is able to change the direction in which the water is jetted out from the nozzle 64. As the orientation in the ship body left-right direction of the deflector 65 is changed, the traveling direction of the ship 50 is changed in the ship body left-right direction. The orientation in the left-right direction of the deflector 65 is changed in accordance with a steering angle of a steering device 57 and a joy stick 59 which will be described below.

The reverse bucket 66 is provided behind the deflector 65 in the ship body front-rear direction. The reverse bucket 66 is switchable between a forward position and a backward position as the reverse bucket 66 is moved in a direction indicated by an arrow shown in FIG. 4 by an unillustrated actuator. At the forward position, the reverse bucket 66 jets out the water from the nozzle 64 and the deflector 65 rearward in the ship body front-rear direction. The ship 50 therefore moves forward when the reverse bucket 66 is at the forward position. At the backward position, the reverse bucket 66 jets out the water from the nozzle 64 and the deflector 65 forward in the ship body front-rear direction. The ship 50 therefore moves rearward when the reverse bucket 66 is at the backward position. The position of the reverse bucket 66 shown in FIG. 4 is the forward position.

As shown in FIG. 2, the seat section 56 includes two seats 56R and 56L. The two seats 56R and 56L are aligned in the ship body left-right direction. The seat 56R is a driver seat. The seat 56L is a passenger seat 56L. The passenger seat 56L is provided to the left of the driver seat 56R in the ship body left-right direction. The driver seat 56R is provided to the right of the passenger seat 56L in the ship body left-right direction.

As shown in FIG. 2 and FIG. 3, the ship body 51 includes a screen 54*a* which is provided at a front portion. The screen 54*a* is provided in front of the seat section 56 in the ship body front-rear direction. The screen 54*a* is made of transparent resin. The screen 54*a* suppresses the intrusion of wind and water into the seat section 56.

The imager 2 is provided behind the screen 54*a* in the ship body 51. The imager 2 is provided at a front portion of the ship body 51. The imager 2 is able to take an image of a docking target and a water surface in front of the ship body 51 in the ship body front-rear direction while the ship body 51 is moved forward in the ship body front-rear direction by the propulsion unit 53. The imager 2 may be a stereo camera which is fixed to the ship body 51. In other words, the photographing direction of the imager 2 is fixed relative to the ship body 51.

The ship 50 includes the steering device 57, a remote controller unit 58, the joy stick 59, a display 4, and an input 5. The steering device 57, the remote controller unit 58, the joy stick 59, the display 4, and the input 5 are provided in front of the driver seat 56R. The steering device 57, the remote controller unit 58, the joy stick 59, and the input 5 are provided to be operable by a driver seated on the driver seat 56R. The display 4 is provided to be viewable by the driver seated on the driver seat 56R.

The steering device 57 is provided at the driver seat 56R. The steering device 57 includes a steering wheel 57*a*. The steering device 57 is operated to steer the ship body 51.

The remote controller unit 58 is operated to switch between forward, neutral, and backward. In addition to this, the remote controller unit 58 is operated to adjust the output of the engine unit 52 when switching between forward and backward. The remote controller unit 58 is lever-shaped. The remote controller unit 58 includes a left throttle lever 58L and a right throttle lever 58R. As the left throttle lever 58L is operated, the left engine 52L and the left thruster 53L are switched to forward, neutral, or backward. Furthermore, as the left throttle lever 58L is operated, the output of the left engine 52L when switching between forward and backward is adjusted. As the right throttle lever 58R is operated, the right engine 52R and the right thruster 53R are switched to forward, neutral, or backward. Furthermore, as the right throttle lever 58R is operated, the output of the right engine 52R when switched between forward and backward is adjusted. By using the remote controller unit 58, the relative speed and the traveling direction in the ship body front-rear direction of the small ship 50 are changed.

The joy stick 59 is operated, for example, to move the ship body 51 in the ship body front-rear direction and the ship body left-right direction when the ship is moving at a low speed. The joy stick 59 is a stick-shaped member. The joy stick 59 is tiltable in the ship body front-rear direction and the ship body left-right direction. As the tilting direction of the joy stick 59 is changed, the orientation of the deflector 65 is changed and the engine unit 52 is switched between forward and backward. The tilt angle of the joy stick 59 is adjustable. As the tilt angle of the joy stick 59 is changed, the output of the engine unit 52 is adjusted. The joy stick 59 changes the traveling direction of the ship body 51 in the ship body front-rear direction and the ship body left-right direction, with the result that the small ship 50 moves or turns.

The display 4 incudes a display device M which displays a still image or a moving image based on an image signal output from a later-described controller 7. The display device M is, for example, a liquid crystal display. The display 4 is mounted on the ship 50.

The input 5 is a device which outputs information to the later-described controller 7. The input 5 is, for example, a touch panel. The input 5 is combined with the display device M of the display 4 to make a touch panel. Through the input 5, information is input in such a way that an object on the screen of the display device M is touched by a finger, a pen, or the like. The input 5 is mounted on the ship 50.

Figure 5:
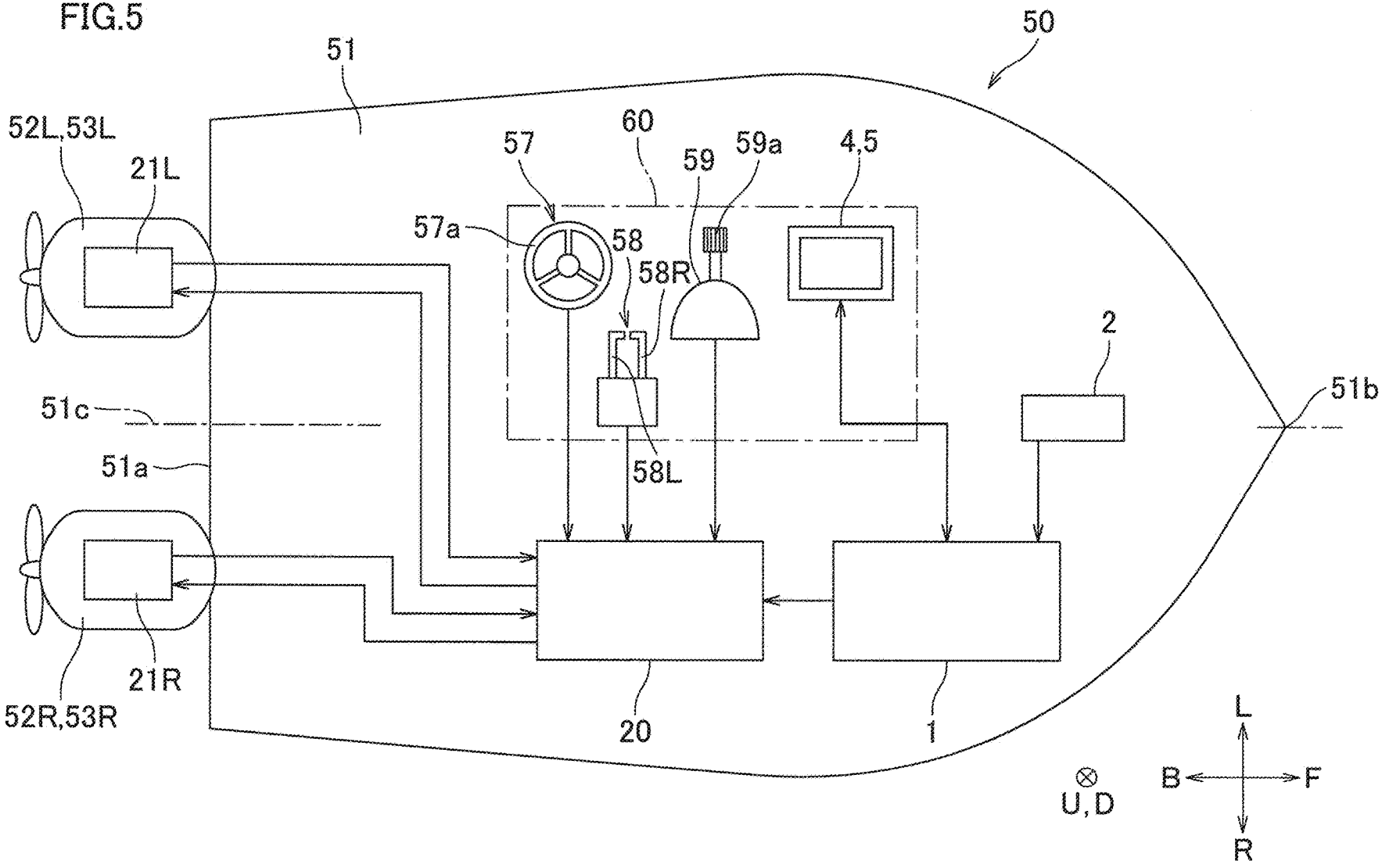
FIG. 5 is a schematic representation showing the electrical configuration of the ship shown in FIG. 2.

The electrical configuration of the ship 50 will be described with reference to FIG. 5. FIG. 5 is a schematic representation of the electrical configuration of the ship. The ship 50 includes the ship docking assisting apparatus 1 and a propulsion unit controller 20. The ship docking assisting apparatus 1 is connected to the display 4 and the input 5. The propulsion unit controller 20 is connected to the steering device 57, the remote controller unit 58, the joy stick 59, and engine control units 21L and 21R. Each of the engine control units 21L and 21R includes an electronic control unit which controls the output of the engine unit 52, the orientation of the deflector 65 in the ship body left-right direction, and the position of the reverse bucket 66. The propulsion unit controller 20 includes an electronic control unit including a microcomputer. The propulsion unit controller 20 is an assist target device to which ship information related to the ship is output, and is connected to the ship docking assisting apparatus 1. The propulsion unit controller 20 has a function of controlling a propulsion force and a function of controlling a steering angle. The ship docking assist processor 10 of the ship docking assisting apparatus 1 has a function of assisting the docking of the ship 50. The ship docking assist processor 10 and the storage 3, which are components of the ship docking assisting apparatus 1, and the propulsion unit controller 20 may be individual electronic control units, or may be a common electronic control unit.

In accordance with an operation by an operator, the steering device 57 outputs a steering signal which indicates the steering angle of the steering wheel 57*a*. The steering signal is input to the propulsion unit controller 20. The propulsion unit controller 20 calculates a target steering angle based on the steering signal. The data representing the target steering angle is output from the propulsion unit controller 20 to the engine control units 21L and 21R. The engine control units 21L and 21R change the orientation of the deflector 65 based on the data representing the target steering angle. As a result, the traveling direction of the small ship 50 is changed in the ship body left-right direction.

The remote controller unit 58 outputs an operation signal indicating the degree of movement and the direction of movement of each of the left throttle lever 58L and the right throttle lever 58R in accordance with the degree of movement and the direction of movement of each of the left throttle lever 58L and the right throttle lever 58R. The operation signal is input to the propulsion unit controller 20. The propulsion unit controller 20 calculates a target throttle opening degree, a target shift position, and a target trim angle based on the operation signal. The target throttle opening degree is a target of the throttle opening degree of the engines 52R and 52L. The target shift position is a shift position of any one of forward, neutral, and backward, and is a shift position that is a target. The target trim angle is a target value of a trim angle which indicates the inclination in the ship body front-rear direction of the ship body 51 relative to the water surface. The data representing the target throttle opening degree, the target shift position, and the target trim angle is output from the propulsion unit controller 20 to the engine control units 21L and 21R. The engine control units 21L and 21R control the rotation speeds of the engines 52R and 52L based on the target throttle opening degree and the target trim angle. As a result, the relative speed of the small ship 50 is controlled. The engine control units 21L and 21R switch the position of the reverse bucket 66 based on the target shift position. As a result, the small ship 50 is switched between forward, neutral, and backward in the ship body front-rear direction.

The joy stick 59 outputs a joy stick operation signal indicating the direction of movement of the joy stick 59 in accordance with the direction of movement of the joy stick 59. The joy stick operation signal is input from the joy stick 59 to the propulsion unit controller 20. The propulsion unit controller 20 calculates the target steering angle based on the joy stick operation signal. The data representing the target steering angle is output from the propulsion unit controller 20 to the engine control units 21L and 21R. The engine control units 21L and 21R change the orientation of the deflector 65 based on the data representing the target steering angle. As a result, the traveling direction of the small ship 50 is changed in the ship body left-right direction. The propulsion unit controller 20 calculates the target throttle opening degree, the target shift position, and the target trim angle based on the joy stick operation signal. The data representing the target throttle opening degree, the target shift position, and the target trim angle is output from the propulsion unit controller 20 to the engine control units 21L and 21R. The engine control units 21L and 21R control the rotation speeds of the engines 52R and 52L based on the target throttle opening degree and the target trim angle. As a result, the relative speed of the small ship 50 is controlled and the switching of the small ship 50 between forward, neutral, and backward in the ship body front-rear direction is controlled. In this way, the small ship 50 moves in the ship body front-rear direction and the ship body left-right direction in accordance with the operation of the joy stick 59.

Figure 6:
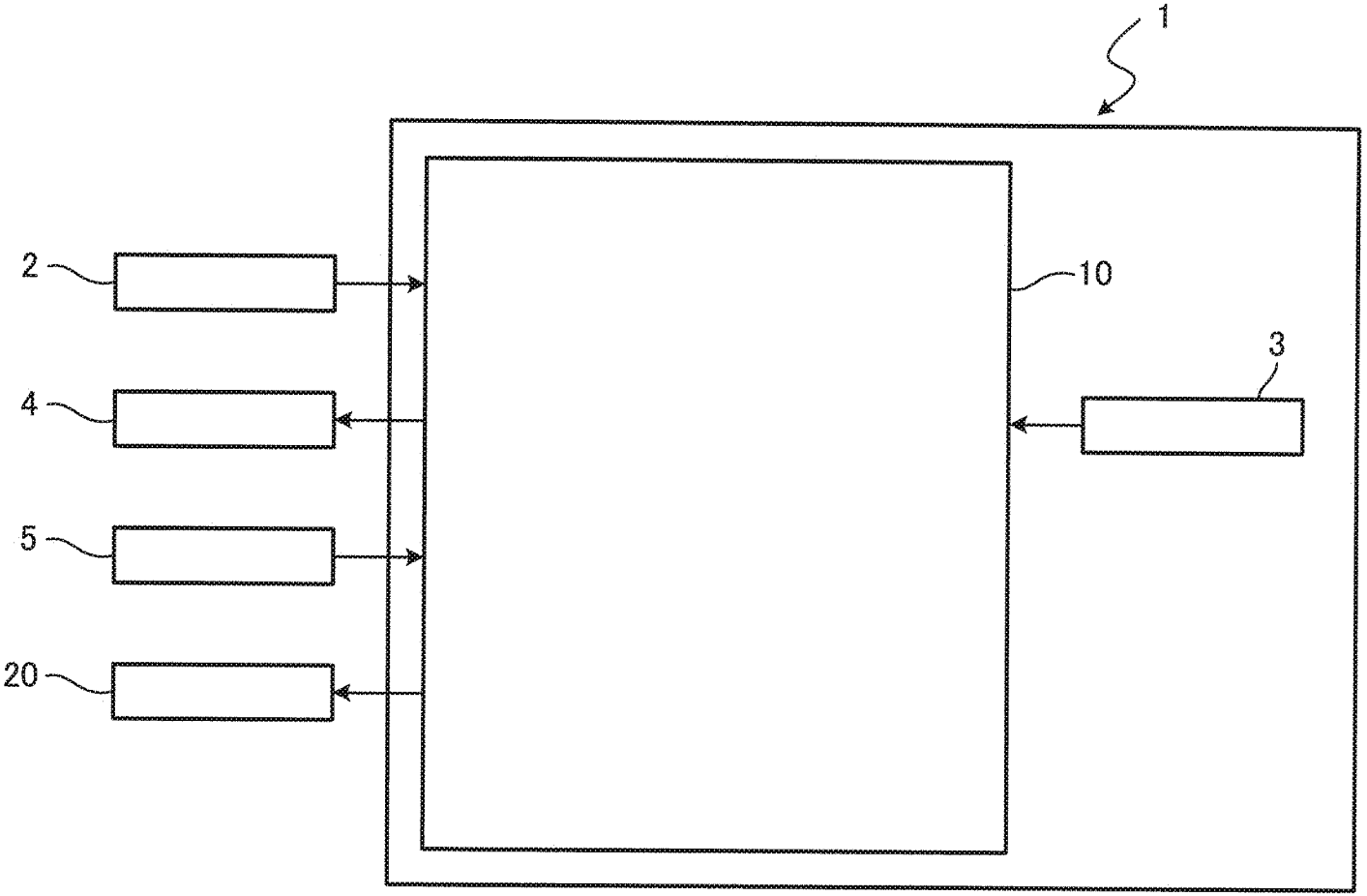
FIG. 6 is a block diagram of the structure of a ship docking assisting apparatus of a specific example.
Figure 7:
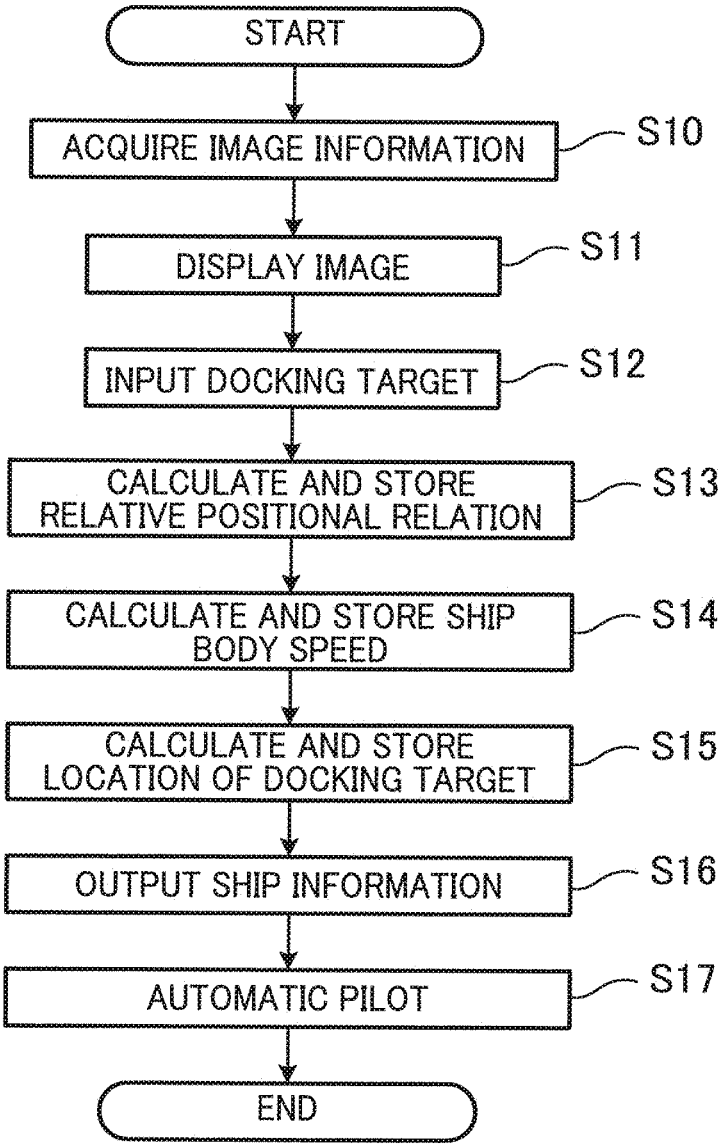
FIG. 7 is a flowchart of steps of a process performed by a ship docking assist processor and a propulsion unit controller of the ship docking assisting apparatus of the specific example.
Figure 8:
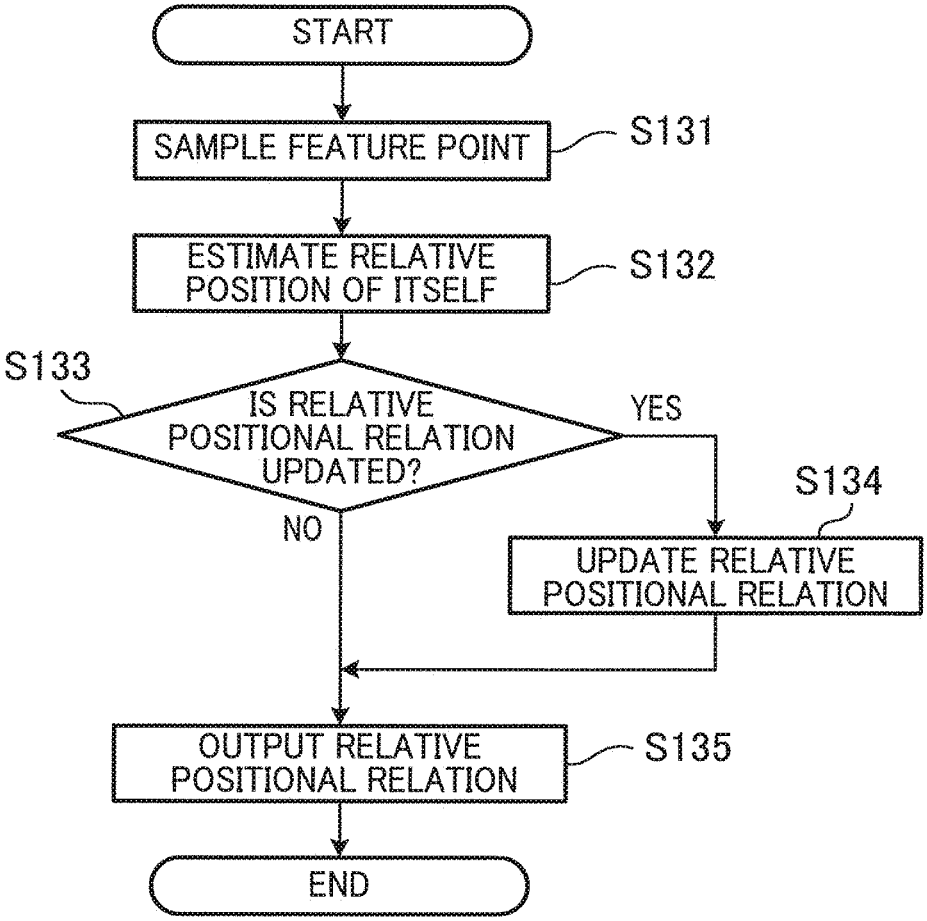
FIG. 8 is a flowchart of detailed steps of a portion of the process performed by the ship docking assist processor of the ship docking assisting apparatus of the specific example.

The structure of the ship docking assisting apparatus 1 will be described with reference to FIG. 6 to FIG. 8. FIG. 6 is a block diagram of the structure of the ship docking assisting apparatus 1. FIG. 7 is a flowchart of steps of a process performed by the ship docking assist processor 10 of the ship docking assisting apparatus 1 and steps of a process performed by the propulsion unit controller 20. In other words, FIG. 7 is a flowchart of steps of a process performed by the ship docking assist processor 10 and steps of a process performed by the propulsion unit controller 20 in the ship docking assist method. FIG. 8 is a flowchart of detailed steps of a portion of the process performed by the ship docking assist processor 10 of the ship docking assisting apparatus 1. In other words, FIG. 8 is a flowchart of detailed steps of a portion of the process performed by the ship docking assist processor 10 in the ship docking assist method.

The ship docking assisting apparatus 1 includes the storage 3 and the ship docking assist processor 10. The ship docking assisting apparatus 1 is connected to the imager 2, the display 4, the input 5, and the propulsion unit controller 20.

The imager 2 is mounted on the ship 50 to take an image of a docking target and a water surface in front of the ship body 51 of the ship 50 in the ship body front-rear direction. The imager 2 may take an image of both the docking target and the water surface. The imager 2 may take an image of only one of the docking target or the water surface. The imager 2 may not take an image of the docking target and the water surface. The imager 2 is provided at a front portion of the ship body 51. The imager 2 includes a stereo camera, for example, in which a plurality of (typically two) monocular cameras are aligned in one housing. The stereo camera reproduces binocular parallax based on slightly different angles. By means of triangulation by a plurality of cameras, the stereo camera recognizes the distance from an object and the shape of an object in three dimensions. In other words, the stereo camera is an imager which is able to add depth information to the image information by simultaneously taking images of an object in different directions. The imager 2 is connected to the ship docking assist processor 10. The imager 2 may be connected to the storage 3.

The storage 3 stores data. The storage 3 is, for example, a RAM (Random Access Memory). The RAM temporarily stores data when the ship docking assist processor 10 executes a program. The storage 3 stores a program executed by the ship docking assist processor 10.

The ship docking assist processor 10 is configured or programmed to execute a series of below-described processes by reading a program stored in the storage 3. When the ship docking assist processor 10 is a programmable processor, the ship docking assist processor 10 may be programmed to execute the series of processes below.

As shown in FIG. 7, the ship docking assist processor 10 acquires image information including the docking target and the water surface taken by the imager 2 (step S10). The docking target is a shore at which the ship is docked or an object in the vicinity of the shore. The ship docking assist processor 10 may acquire image information including the docking target and the water surface taken by the imager 2. The ship docking assist processor 10 may acquire image information including an image of only one of the docking target and the water surface taken by the imager 2. The ship docking assist processor 10 may acquire image information not including the docking target and the water surface taken by the imager 2.

Figure 9:
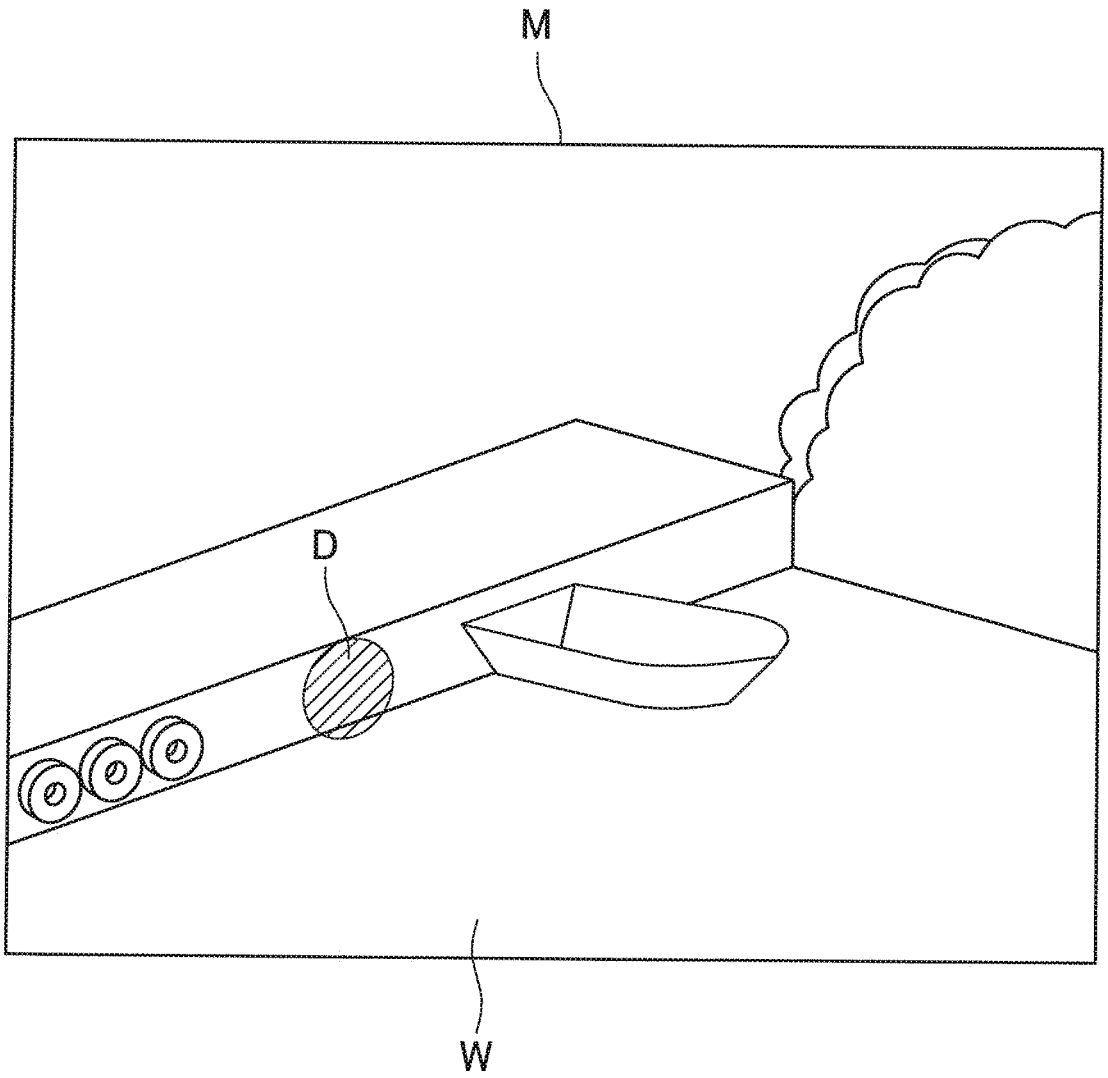
FIG. 9 shows an example of an image displayed on a display of a ship on which the ship docking assisting apparatus of the specific example is mounted.

The ship docking assist processor 10 displays, on the display device M of the display 4, an image including the docking target D and the water surface W taken by the imager 2 (step S11). An example of the image displayed on the display device M is shown in FIG. 9. As shown in FIG. 9, the display device M displays the docking target D and the water surface W which are located forward of the ship body 51. FIG. 9 shows a case where the docking target D is a shore at which the ship is docked.

The ship docking assist processor 10 displays, on the display device M of the display 4, an image including the docking target and the water surface based on image information taken by the imager 2. The ship docking assist processor 10 acquires information of the docking target specified by the operator using the input 5 while the image is displayed on the display device M (step S12). For example, as shown in FIG. 9, the docking target D forward of the ship body 51 and displayed on the display device M is specified by using the input 5. When the docking target D is the shore at which the ship is docked, the docking target D specified by the input 5 may be an approximate position of the shore at which the ship 50 is docked. The docking target D may be a wharf which extends along the ship body front-rear direction of the ship 50 or a wharf which extends in a direction perpendicular to the ship body front-rear direction of the ship 50. When the docking target D is an object in the vicinity of the shore at which the docking target D is docked, the docking target D specified by the input 5 is, for example, a bollard at the wharf. The ship docking assist processor 10 may determine whether a space of the docking target D specified by the operator using the input 5 is a space in which docking is possible. Whether docking is possible at the space is determined in comparison with the size of the ship 50. When the space of the docking target D is smaller than the size of the ship body 51, the docking target D may not be specifiable by the input 5 or a message that the space cannot be specified as the docking target D may be displayed on the display 4.

The ship docking assist processor 10 calculates at least one relative positional relationship between the ship body 51 and the docking target from a plurality of sets of image information obtained while the ship 50 moves forward in the ship body front-rear direction (step S13). The sets of the image information include at least two sets of image information of both the docking target and the water surface. The relative positional relationship is the three-dimensional relative positional relationship between the ship body 51 and the docking target. The ship docking assist processor 10 then stores the calculated at least one relative positional relationship between the ship body 51 and the docking target in the storage 3, as ship information (step S13). Hereinafter, the relative positional relationship between the ship body 51 and the docking target may be simply referred to as relative positional relationship.

Figure 11:
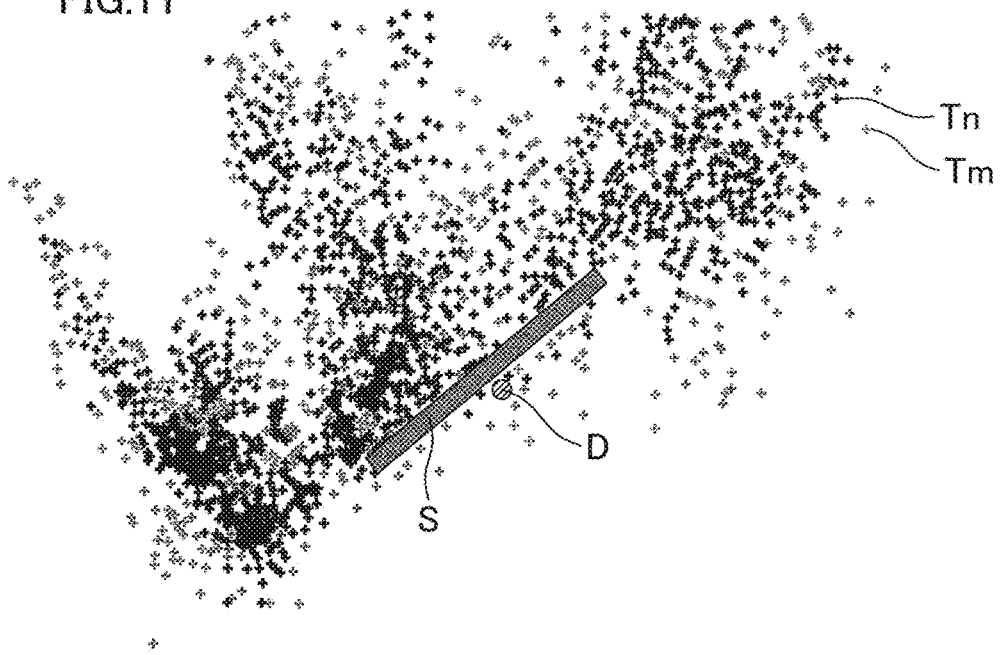
FIG. 11 shows an example of ship information displayed on the display of the ship on which the ship docking assisting apparatus of the specific example is mounted.
Figure 11:
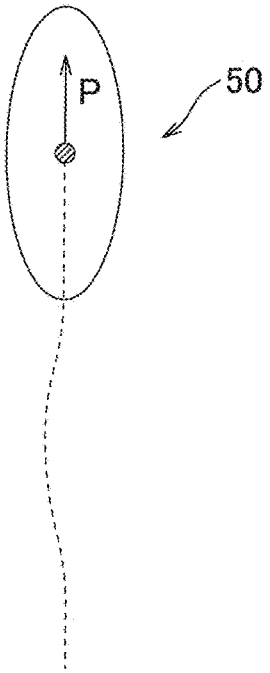

How the step S13 is specifically performed will be described with reference to FIG. 8. As shown in FIG. 8, the ship docking assist processor 10 samples a feature point of the docking target, which is acquired from a plurality of sets of image information (step S131). The feature point is, for example, a point where the brightness significantly varies. To be more specific, for example, a point where the difference in brightness between two neighboring pixels is equal to or larger than a predetermined value is a feature point. The ship docking assist processor 10 samples a feature point of a border line S of the water surface W from sets of image information including the docking target and the water surface. Then, from the sampled feature point of the border line S of the water surface W, a feature point of the docking target D in the vicinity of the border line S of the water surface W is sampled. FIG. 11 shows a specific example of feature points obtained from a plurality of sets of image information by the ship docking assist processor 10. In FIG. 11, feature points obtained at the current timing Tn are indicated by black marks. As ship information, the storage 3 stores a past relative positional relationship which are feature points of the docking target sampled at a timing Tm which is before the current timing Tn. In FIG. 11, feature points around the docking target are also sampled in the same manner as the feature points of the docking target. The feature points around the docking target may be or may not be sampled. In FIG. 11, feature points obtained at the past timing Tm are indicated by gray marks. In FIG. 11, the bow direction of the ship body 51 is indicated by an arrow P. The bow direction P is a current forward direction of the ship body. Subsequently, the ship docking assist processor 10 associates the sampled feature points with each other with reference to the past relative positional relationship stored in the storage 3 as ship information, and sets the associated feature points as associated points. Based on the associated points, the position of the ship body 51 relative to the docking target D is estimated (step S132). FIG. 11 shows a specific example of the relative position of the ship body 51 estimated by the ship docking assist processor 10. In FIG. 11, the relative position is a two-dimensional relative position of the ship body 51 estimated at the timing Tn. In FIG. 11, the two-dimensional relative position of the ship body 51 estimated at the timing Tm before the timing Tn is shown by a dotted line. The past timing Tm may be a particular single time point or a plurality of time points. The ship docking assist processor 10 then determines whether to update the past relative positional relationship between the ship body 51 and the docking target stored in the storage 3 (step S133). When one of the following update conditions is satisfied, it is determined that the past relative positional relationship between the ship body 51 and the docking target stored in the storage 3 will be updated. An update condition is, for example, a condition in which a predetermined ratio or more of sampled feature points do not have associated feature points in the past relative positional relationship. Another update condition is, for example, a condition in which the difference between the estimated relative position of the ship body 51 and the distance of the relative position of the ship body 51 stored in the past relative positional relationship becomes equal to or more than a predetermined value. When the ship docking assist processor 10 determines that the past relative positional relationship between the ship body 51 and the docking target stored in the storage 3 will be updated (step S133: YES), the past relative positional relationship stored in the storage 3 is updated by storing the relative positions of the ship body 51 and the docking target estimated based on the sampled feature points in the storage 3 (step S134), and then the process proceeds to the step S135. When the ship docking assist processor 10 determines that the past relative positional relationship between the ship body 51 and the docking target stored in the storage 3 will not be updated (step S133: NO), the process proceeds to the step S135. In the step S135, the ship docking assist processor 10 outputs the estimated relative positions of the ship body 51 and the docking target as the relative positional relationship between the ship body 51 and the docking target, and stores the relative positional relationship in the storage 3 as ship information. The ship docking assist processor 10 executes the above-described steps S131 to S135 at predetermined time intervals.

Now, FIG. 7 is explained again. The ship docking assist processor 10 calculates the speed of the ship body 51 relative to the docking target D based on a plurality of relative positional relationships (step S14). Hereinafter, the speed of the ship body 51 relative to the docking target D may be simply referred to as relative speed of the ship body 51. The relative positional relationships are relative positional relationships obtained at different timings. The ship docking assist processor 10 calculates the moving distance of the ship body 51 based on the relative positional relationships obtained at different timings. The ship docking assist processor 10 calculates the relative speed of the ship body 51 based on the moving distance of the ship body 51 and intervals between the timings at which the relative positional relationships were obtained. The ship docking assist processor 10 stores the calculated relative speed of the ship body 51 in the storage 3 as ship information (step S14).

Figure 10:
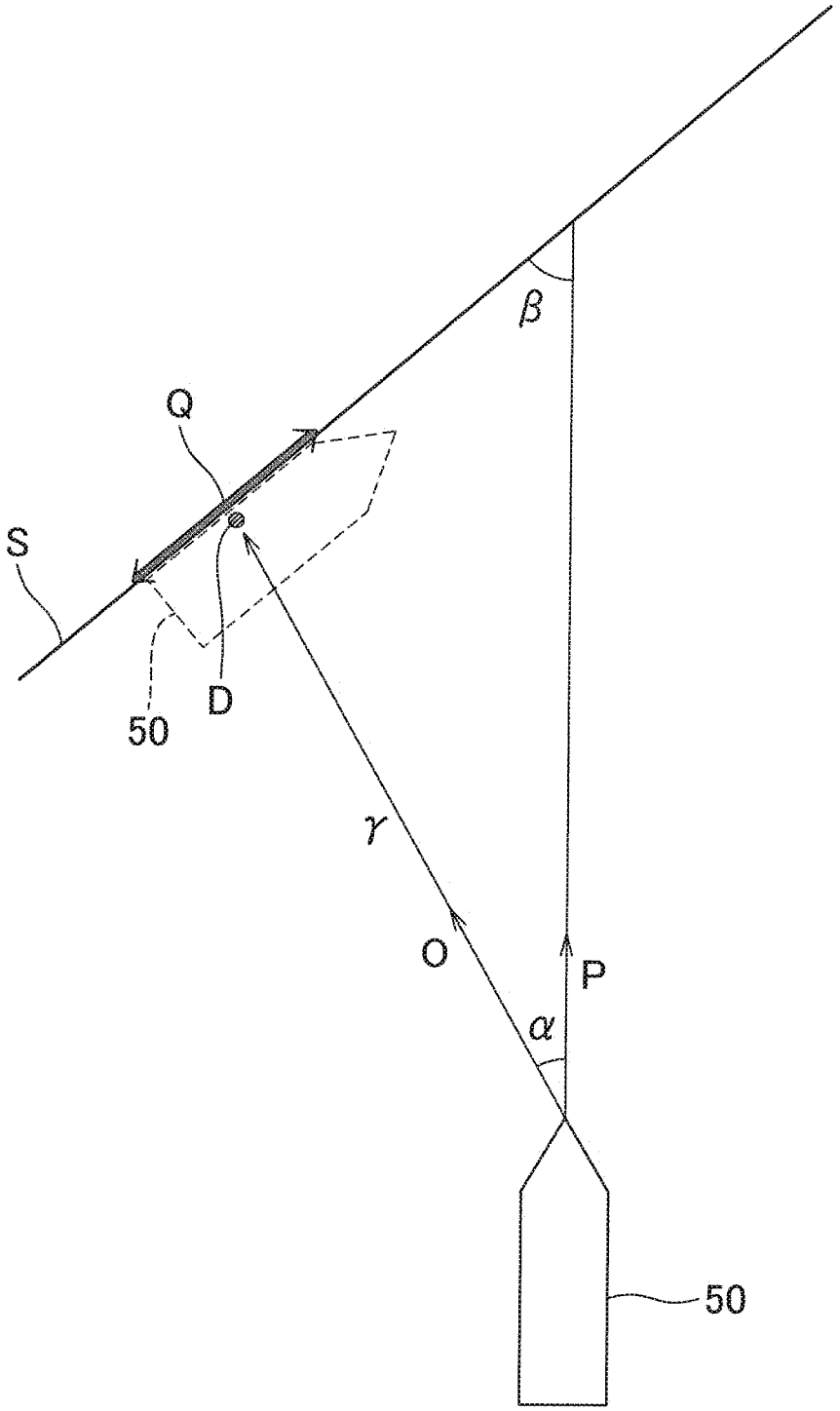
FIG. 10 shows the relationship between a target angle, an approach angle, and a target distance of the ship on which the ship docking assisting apparatus of the specific example is mounted.

The ship docking assist processor 10 calculates a target angle, an approach angle, and a target distance based on the obtained at least one relative positional relationship (step S15). The relationship between a target angle, an approach angle, and a target distance is shown in FIG. 10. As shown in FIG. 10, a target angle $\alpha$ is an angle between a bow direction P and a target direction O. The target direction O is a direction in which the docking target D is located relative to the ship body 51. The approach angle $\beta$ is an angle formed between a docking direction Q and the bow direction P. The docking direction Q is a direction of the border line S between the shore at which the ship body 51 is docked and the water surface. The docking direction Q is parallel to the ship body front-rear direction of the ship body 51 when the ship is docked at the shore. In FIG. 10, the ship body 51 being docked at the shore is indicated by dotted lines. The target distance $\gamma$ is the shortest distance between the ship body 51 and the docking target D. To be more specific, the ship docking assist processor 10 calculates a target angle, an approach angle, and a target distance based on the obtained at least one relative positional relationship between the ship body 51 and the docking target. The ship docking assist processor 10 then stores the target angle, the approach angle, and the target distance having been calculated in the storage 3, as ship information (step S15).

The ship docking assist processor 10 outputs at least one set of ship information stored in the storage 3 to the propulsion unit controller 20 (step S16). In this specific example, the propulsion unit controller 20 performs automatic pilot using the output ship information (step S17). To be more specific, by using the output ship information, the propulsion unit controller 20 generates a command signal to control the propulsion unit 53 (step S17). By using the generated command signal, the propulsion unit controller 20 controls the propulsion unit 53 so that the ship body 51 moves automatically (step S17). In this way, the ship docking assisting apparatus 1 is able to assist the docking of the ship 50. To be more specific, the propulsion unit controller 20 calculates a target steering angle based on the target angle α, the approach angle β, and the like, which are sets of ship information. Data representing the target steering angle is output from the propulsion unit controller 20 to the engine control units 21L and 21R, as the command signal to control the propulsion unit 53. The engine control units 21L and 21R automatically change the orientation of the deflector 65 based on the data representing the target steering angle. As a result, the traveling direction in the ship body left-right direction of the small ship 50 is automatically changed. In addition to the above, the propulsion unit controller 20 calculates a target throttle opening degree, a target shift position (forward, neutral, or backward), and a target trim angle based on the target distance γ, the relative speed of the ship 50, etc., which are sets of ship information. The data representing the target throttle opening degree, the target shift position, and the target trim angle is output from the propulsion unit controller 20 to the engine control units 21L and 21R as the command signal to control the propulsion unit 53. The engine control units 21L and 21R automatically control the rotation speeds of the engines 52R and 52L based on the target throttle opening degree and the target trim angle. As a result, the relative speed of the small ship 50 is automatically controlled and the switching of the small ship 50 between forward, neutral, and backward in the ship body front-rear direction is automatically controlled.

According to the above features, the ship docking assisting apparatus 1 and the ship docking assisting method of the specific example exert the following effects, in addition to the effects of the ship docking assisting apparatus 1 and the ship docking assisting method of the present preferred embodiment.

The imager 2 is provided at a front portion of the ship body 51. Furthermore, the imager 2 is able to take an image of a docking target D and a water surface W in front of the ship body 51 in the ship body front-rear direction, while the ship body 51 moves forward in the ship body front-rear direction by the propulsion unit 53. As a result, when the ship 50 is moving forward in the approaching operation, it is easy to take an image of the docking target D and the water surface W. In other words, the ship docking assisting apparatus 1 easily obtains image information in which an image of the docking target D taken by the imager 2 is included. The ship docking assisting apparatus 1 and the ship docking assisting method of the specific example are able to assist the ship 50 to be further accurately docked while reducing hardware resources. When, for example, in the docking operation of the ship 50, the ship body 51 is provided so that the ship body front-rear direction is along the wharf, the ship docking assist processor 10 may not be able to obtain image information including an image of the docking target D from the imager 2 which takes an image in front of the ship body 51 in the ship body front-rear direction. Even in such a case, in the approaching operation, the ship docking assisting apparatus 1 and the ship docking assisting method store the relative positional relationship between the ship body 51 and the docking target D in advance in the storage 3 as ship information. As a result, the ship docking assist processor 10 is able to perform automatic pilot by using the output ship information, even in the case above.

The ship docking assist processor 10 displays, on the display 4, an image including the docking target D and the water surface W based on image information taken by the imager 2. The display 4 is a device that displays information. The ship docking assist processor 10 acquires information of the docking target D set by using the input 5, while an image including the docking target D and the water surface W is displayed on the display device M of the display 4. The input 5 is a device by which information is input. This allows the operator of the ship 50 to set the docking target D at will. The ship docking assisting apparatus 1 and the ship docking assisting method of the specific example are able to assist the ship 50 to be further accurately docked at a shore desired by the operator while reducing hardware resources.

The ship docking assist processor 10 calculates the speed of the ship body 51 relative to the docking target D based on a plurality of relative positional relationships. The ship docking assist processor 10 stores the relative speed of the ship body 51 in the storage 3 as ship information. The ship docking assist processor 10 is therefore able to further output the relative speed of the ship body 51 as ship information. In this way, the ship docking assisting apparatus 1 and the ship docking assisting method are able to use the relative positional relationship between the ship body 51 and the docking target D and the relative speed of the ship body 51 to assist the docking. The ship docking assisting apparatus 1 and the ship docking assisting method of the specific example are therefore able to assist the ship 50 to be further accurately docked while reducing hardware resources.

The ship docking assist processor 10 calculates a target angle α, an approach angle β, and a target distance γ based on at least one relative positional relationship. The target angle α is an angle between a bow direction P and a target direction O. The bow direction P is a forward direction of the ship body 51. The target direction O is a direction in which the docking target D is located relative to the ship body 51. The approach angle β is an angle formed between a docking direction Q and the bow direction P. The docking direction Q is a direction of the border line between the shore at which the ship body 51 is docked and the water surface. The target distance γ is the shortest distance between the ship body 51 and the docking target D. The ship docking assist processor 10 then stores the target angle α, the approach angle β, and the target distance γ having been calculated in the storage 3 as ship information. In other words, the target angle α, the approach angle β, and the target distance γ are output to the assist target device 8 and used to assist the docking. The target angle α, the approach angle β, and the target distance γ which are output as ship information are easily used to assist the docking of the ship 50 by the propulsion unit controller 20 which is an assist target device. Because the ship information is easily used, the ship information is easily processed in the propulsion unit controller 20. It is therefore possible to reduce hardware resources by further improving the efficiency of the processing of the ship information in the propulsion unit controller 20. The ship docking assisting apparatus 1 and the ship docking assisting method of the specific example are able to assist the ship 50 to be further accurately docked while further reducing hardware resources.

The assist target device is the propulsion unit controller 20 which is able to control the propulsion unit 53. The ship docking assist processor 10 outputs ship information from the storage 3 to the propulsion unit controller 20. The propulsion unit controller 20 generates a command signal to control the propulsion unit 53 using the ship information output from the storage 3. The propulsion unit controller 20 controls the propulsion unit 53 with the command signal. The propulsion unit 53 is provided in the ship body 51 to generate a propulsion force to move the ship body 51. The ship docking assisting apparatus 1 and the ship docking assisting method are therefore able to assist the approaching operation and the docking operation to be automatically performed until the ship 50 is docked. In the propulsion unit controller 20 which is the assist target device, the ship information is easily used to assist the docking of the ship 50. Because the ship information is easily used, the ship information is easily processed in the propulsion unit controller 20. It is therefore possible to reduce hardware resources by further improving the efficiency of the processing of the ship information in the propulsion unit controller 20. The ship docking assisting apparatus 1 and the ship docking assisting method of the specific example are therefore able to assist the ship 50 to be further accurately docked while further reducing hardware resources.

The present invention is not limited to the above-described preferred embodiments and its specific examples, and various changes can be made within the scope of the claims. The following describes modifications of the preferred embodiment of the present invention. Components having the same structure as those described above will be given the same reference numerals, and the description thereof will be omitted, if appropriate. The preferred embodiments and the specific examples described above and the below-described modifications may be used in combination as needed.

In the ship docking assisting apparatuses and the ship docking assisting methods according to preferred embodiments of the present invention described above, the ship 50 is preferably a jet propulsion boat. Alternatively, in the ship docking assisting apparatuses and the ship docking assisting methods according to preferred embodiments of the present invention, the ship may be a small ship of another type. For example, the ship may be a small ship including an outboard engine including a propeller driven by an engine. In other words, the propulsion unit is not limited to a jet propulsion unit, and may be another propulsion unit such as an outboard engine. In addition to the above, in regard to the ship docking assisting apparatuses and the ship docking assisting methods according to preferred embodiments of the present invention, the ship may be a large ship.

In the ship docking assisting apparatuses and the ship docking assisting methods according to preferred embodiments of the present invention described above, the imager 2 is preferably a stereo camera fixed to the ship body 51. Alternatively, in the ship docking assisting apparatuses and the ship docking assisting methods according to preferred embodiments of the present invention, the imager may include a stereo camera and a movable device which allows the stereo camera to be movable. In other words, the photographing direction of the imager with respect to the ship body may be changeable. The movable device includes, for example, a rotating base which allows the stereo camera to rotate at least in the ship body left-right direction or the ship body up-down direction and a driving device configured to drive the rotating base. The movable device includes, for example, a sliding base which allows the stereo camera to slide at least in the ship body left-right direction or the ship body up-down direction and a driving device configured to drive the sliding base. The movable device includes, for example, a rotating base which allows the stereo camera to slide at least in the ship body left-right direction or the ship body up-down direction, a sliding base which allows the stereo camera to slide at least in the ship body left-right direction or the ship body up-down direction, and a driving device configured to drive the rotating base and the sliding base. When the imager includes the movable device, in the approaching operation, the imager takes an image of a docking target and a water surface forward of the ship body in the ship body front-rear direction. In the imager, in the docking operation, the stereo camera may be rotated to take an image of a docking target and a water surface which are to the left of or to the right of the ship body in the ship body front-rear direction.

In the ship docking assisting apparatuses and the ship docking assisting methods according to preferred embodiments of the present invention described above, the imager 2 is preferably a stereo camera. Alternatively, in the ship docking assisting apparatuses and the ship docking assisting methods according to preferred embodiments of the present invention, the imager may be a monocular camera, a TOF (Time Of Flight) camera, or a camera of another type. When the imager is a monocular camera, for example, at least one relative positional relationship between the ship body and the docking target is calculated based on the size of the object in the vicinity of the docking target, which is known in advance. Alternatively, when the imager is a monocular camera, for example, at least one relative positional relationship between the ship body and the docking target is calculated based on the height, from the water surface, of the object in the vicinity of the docking target, which is known in advance. Alternatively, when the imager is a monocular camera, for example, at least one relative positional relationship between the ship body and the docking target is calculated based on an optical flow. Alternatively, when the imager is a monocular camera, for example, at least one relative positional relationship between the ship body and the docking target is calculated by obtaining a moving distance by using another sensor such as an odometer and an IMU (Inertial Measurement Unit). The imager may include a monocular camera, a TOF (Time Of Flight) camera, or a camera of another type and a movable device which allows the camera to be movable provided. Alternatively, the imager may be a portable terminal which is mounted on the ship and is portable. The portable terminal includes a camera such as a stereo camera. In this case, the imager may be arranged such that a portable terminal can be fixed to the ship. In this case, the imager may include a portable terminal and a movable device which allows the portable terminal to be movable.

In the ship docking assisting apparatuses and the ship docking assisting methods according to preferred embodiments of the present invention described above, the display 4 preferably includes a liquid crystal display. Alternatively, in the ship docking assisting apparatuses and the ship docking assisting methods according to preferred embodiments of the present invention, the display may be an organic EL display, a video projector, a plasma display, or a cathode ray tube.

In the ship docking assisting apparatuses and the ship docking assisting methods according to preferred embodiments of the present invention described above, the ship docking assist processor 10 preferably displays, on the display device M of the display 4, image information including the docking target D and the water surface W taken by the imager 2 (step S11). However, in the ship docking assisting apparatuses and the ship docking assisting methods according to preferred embodiments of the present invention, the ship docking assist processor may not display, on the display, image information including the docking target and the water surface taken by the imager.

In the ship docking assisting apparatuses and the ship docking assisting methods according to preferred embodiments of the present invention described above, the ship docking assist processor 10 preferably acquires information of the docking target set by the operator using the input 5, while an image including the docking target and the water surface is displayed on the display 4 (step S12). Alternatively, in the ship docking assisting apparatuses and the ship docking assisting methods according to preferred embodiments of the present invention, the docking target may be input from the outside in advance. In other words, in the ship docking assisting apparatus and the ship docking assisting method, the feature points of the docking target may be set in advance. Alternatively, in the ship docking assisting apparatuses and the ship docking assisting methods according to preferred embodiments of the present invention, the ship docking assist processor may detect a place where the ship can be docked and set the detected place as the docking target.

In the ship docking assisting apparatuses and the ship docking assisting methods according to preferred embodiments of the present invention described above, the ship docking assist processor 10 preferably samples the docking target based on the feature points obtained from a plurality of sets of image information, and calculates at least one relative positional relationship. Alternatively, in the ship docking assisting apparatuses and the ship docking assisting methods according to preferred embodiments of the present invention, the ship docking assist processor may sample a docking target using machine learning or template matching, and calculate at least one relative positional relationship. In the machine learning, the ship docking assist processor samples a docking target by searching image information for the docking target which is learned in advance. In the template matching, the ship docking assist processor searches image information for a region similar to a reference picture of a docking target, and samples the docking target.

In the ship docking assisting apparatuses and the ship docking assisting methods according to preferred embodiments of the present invention described above, the ship docking assist processor 10 preferably calculates the speed of the ship body 51 relative to the docking target, and stores the calculated speed as ship information. Alternatively, in the ship docking assisting apparatuses and the ship docking assisting methods according to preferred embodiments of the present invention, the ship docking assist processor may not calculate the speed of the ship body relative to the docking target.

In the ship docking assisting apparatuses and the ship docking assisting methods according to preferred embodiments of the present invention described above, the ship docking assist processor 10 preferably calculates a target angle, an approach angle, and a target distance and stores them as ship information. Alternatively, in the ship docking assisting apparatuses and the ship docking assisting methods according to preferred embodiments of the present invention, the ship docking assist processor may not calculate a target angle, an approach angle, and a target distance.

In the ship docking assisting apparatuses and the ship docking assisting methods according to preferred embodiments of the present invention, the assist target device preferably is the propulsion unit controller 20. The propulsion unit controller 20 generates a command signal to control the propulsion unit 53 by using output ship information. The propulsion unit controller 20 controls the propulsion unit 53 with the command signal. Alternatively, in the ship docking assisting apparatuses and the ship docking assisting methods according to preferred embodiments of the present invention, the propulsion unit controller may generate a command signal to control the propulsion unit by using the output ship information and in accordance with an operation by the operator. The propulsion unit controller controls the propulsion unit by using the command signal. To put it differently, the ship 50 is manually operated by the operator in this case. In addition to this, for example, the ship docking assist processor 10 generates a command signal to control the propulsion unit based on operations by the operator using the steering device 57, the remote controller unit 58, and the joy stick 59. The ship docking assist processor 10 therefore calculates the target steering angle based on the target angle $\alpha$, the approach angle $\beta$, etc. stored in the storage 3 as ship information. Furthermore, the ship docking assist processor 10 calculates a target throttle opening degree, a target shift position, and a target trim angle based on the target distance $\gamma$, the relative speed of the ship 50, etc. The ship docking assist processor 10 then compares the operation amounts of the steering device 57, the remote controller unit 58, and the joy stick 59 operated by the operator with the target steering angle, the target throttle opening degree, the target shift position, and the target trim angle which have been calculated. The ship docking assist processor 10 adjusts the degree of change of the direction of the deflector 65, the amount of output of the engine unit 52, and the switching between the forward and rearward of the engine unit 52 based on the operation amounts of the steering device 57, the remote controller unit 58, and the joy stick 59 which are operated by the operator, and the target steering angle, the target throttle opening degree, the target shift position, and the target trim angle which have been calculated. In other words, the ship docking assist processor 10 assists the operations when the operation amounts of the steering device 57, the remote controller unit 58, and the joy stick 5 operated by the operator are different from the target steering angle, the target throttle opening degree, the target shift position, and the target trim angle which have been calculated. With this, the ship docking assisting apparatuses and the ship docking assisting methods according to preferred embodiments of the present invention are able to assist the operations by the operator in the approaching operation and docking operation until the ship is docked. In the propulsion unit controller 20 which is the assist target device, the ship information is easily used to assist the docking of the ship. Because the ship information is easily used, the ship information is easily processed in the propulsion unit controller. It is therefore possible to reduce hardware resources by further improving the efficiency of the processing of the ship information in the propulsion unit controller. The ship docking assisting apparatuses and the ship docking assisting methods according to preferred embodiments of the present invention are therefore able to assist the ship to be further accurately docked.

In the ship docking assisting apparatuses and the ship docking assisting methods according to preferred embodiments of the present invention described above, the assist target device may be a display. In this case, the ship docking assist processor outputs ship information from the storage to the display. The display displays ship information or information generated based on the ship information. The ship 50 may be manually operated by the operator. To be more specific, for example, the display 4 may display relative positional relationship which is ship information on the display device M. The display 4 may display, on the display device M, a target angle α, an approach angle β, a target distance γ, and relative speed of the ship 50 which are sets of ship information. Furthermore, the display 4 may calculate a target steering angle based on the target angle α and the approach angle β which are sets of ship information, and display the target steering angle on the display device M. Furthermore, the display 4 may calculate a target throttle opening degree, a target shift position, and a target trim angle based on the target distance γ and the relative speed of the ship 50, and display the calculated items on the display device M.

In the ship docking assisting apparatuses and the ship docking assisting methods according to preferred embodiments of the present invention described above, the assist target device may be a notification device. In this case, the ship docking assist processor outputs ship information from the storage to the notification device. The notification device notifies ship information or information generated based on the ship information. The ship may be manually operated by the operator. To be more specific, for example, the notification device may calculate a target steering angle based on the target angle α and the approach angle β which are sets of ship information, and notify the target steering angle. Furthermore, the notification device may calculate a target throttle opening degree, a target shift position, and a target trim angle based on the target distance γ and the relative speed of the ship, and notify the calculated items.

In the ship docking assisting apparatuses and the ship docking assisting methods according to preferred embodiments of the present invention described above, the assist target device may be at least two of the propulsion unit controller, the display, or the notification device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A ship docking assisting apparatus that assists docking of a ship by outputting ship information related to the ship to an assist target device, the ship docking assisting apparatus comprising:

a storage to store information;

an imager mounted on the ship and provided at a front portion of a ship body, which is a front half of the ship body, so as to take an image only in front and forward of the ship body while the ship body is moved forward in a ship body front-rear direction by a propulsion unit; and a ship docking assist processor configured or programmed to assist docking of the ship and including an approaching operation to cause the ship to approach a shore until the ship is positioned parallel or perpendicular to the shore, and a docking operation, different from the approaching operation, performed after the ship approaches the shore by the approaching operation to cause the ship to make contact with or come closer to the shore, the ship docking assist processor being configured or programmed to assist docking by:

acquiring image information of a docking target and a water surface in front of the ship body taken only by the imager provided at the front portion of the ship body during the approaching operation, the docking target being a shore at which the ship is docked or an object in a vicinity of the shore and is used as a mark when the ship is docked;

calculating at least one relative positional relationship that indicates a relationship in distance and direction between the ship body of the ship and the docking target, from among a plurality of sets of the image information including the docking target and the water surface, which are acquired while the ship body is moved forward in the ship body front-rear direction by the propulsion unit;

storing the at least one relative positional relationship in the storage as the ship information;

outputting the ship information stored in the storage to the assist target device; and continuing the approaching operation and the docking operation until the ship is docked.

2. The ship docking assisting apparatus according to claim 1, wherein the ship docking assist processor is configured or programmed to:

display an image including the docking target and the water surface on a display mounted on the ship based on image information taken by the imager; and obtain information of the docking target input by an operator on an input mounted on the ship when the image including the docking target and the water surface is displayed on the display.

3. The ship docking assisting apparatus according to claim 1, wherein the ship docking assist processor is configured or programmed to:

calculate a relative speed of the ship body from a plurality of the at least one relative positional relationship; and store the relative speed of the ship body relative to the docking target in the storage as the ship information.

4. The ship docking assisting apparatus according to claim 1, wherein the ship docking assist processor is configured or programmed to calculate from the at least one relative positional relationship:

(i) a target angle defined as an angle between a bow direction corresponding to a current forward direction of the ship body and a target direction corresponding to a direction of the docking target relative to the ship body;

(ii) an approach angle defined as an angle between the bow direction and a docking direction corresponding to a direction of a border line between a shore at which the ship body is docked and the water surface; and (iii) a target distance which is a shortest distance between the ship body and the docking target; and the ship docking assist processor stores the target angle, the approach angle, and the target distance in the storage as the ship information.

5. The ship docking assisting apparatus according to claim 1, wherein the assist target device is a propulsion unit controller that controls the propulsion unit;

the ship docking assist processor is configured or programmed to output the ship information from the storage to the propulsion unit controller; and the propulsion unit controller generates a command signal to control the propulsion unit by using the ship information, and controls the propulsion unit with the command signal so that the ship body is automatically moved.

6. The ship docking assisting apparatus according to claim 1, wherein the assist target device is a propulsion unit controller that controls the propulsion unit;

the ship docking assist processor is configured or programmed to output the ship information from the storage to the propulsion unit controller; and in accordance with an operation by an operator, the propulsion unit controller generates a command signal to control the propulsion unit by using the ship information output from the storage, and controls the propulsion unit with the command signal.

7. The ship docking assisting apparatus according to claim 1, wherein the assist target device is a display that displays information;

the ship docking assist processor is configured or programmed to output the ship information from the storage to the display; and the display displays the ship information or information generated based on the ship information.

8. A ship docking assisting method of assisting docking of a ship using a ship docking assist processor including an approaching operation to cause the ship to approach a shore until the ship is positioned parallel or perpendicular to the shore, and a docking operation, different from the approaching operation, performed after the ship approaches the shore by the approaching operation to cause the ship to make contact with or come closer to the shore by outputting ship information related to the ship to an assist target device, the method comprising, under control of the ship docking assist processor:

acquiring image information of a docking target and a water surface in front of a ship body taken only by an imager mounted on the ship at a front portion of the ship body, which is a front half of the ship body, so as to take an image only in front and forward of the ship body while the ship body of the ship is moved forward in a ship body front-rear direction by a propulsion unit during the approaching operation, and that includes the docking target and the water surface, the docking target being a shore at which the ship is docked or an object in a vicinity of the shore and is used as a mark when the ship is docked;

calculating at least one relative positional relationship that indicates a relationship between the ship body of the ship and the docking target from a plurality of sets of the image information including the docking target and the water surface, that are acquired while the ship body is moved forward in the ship body front-rear direction by the propulsion unit;

storing the at least one relative positional relationship in the storage as the ship information;

outputting the ship information stored in the storage to the assist target device; and continuing the approaching operation and the docking operation until the ship is docked.

* * * * *